US007641572B2

(12) United States Patent
Aoyama et al.

(10) Patent No.: US 7,641,572 B2
(45) Date of Patent: Jan. 5, 2010

(54) GOLF BALL DIMPLES WITH A CATENARY CURVE PROFILE

(75) Inventors: Steven Aoyama, Fairhaven, MA (US); Nicholas M. Nardacci, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/071,087

(22) Filed: Feb. 15, 2008

(65) Prior Publication Data

US 2008/0220907 A1 Sep. 11, 2008

Related U.S. Application Data

(60) Continuation-in-part of application No. 11/907,195, filed on Oct. 10, 2007, now Pat. No. 7,491,137, which is a continuation of application No. 11/607,916, filed on Dec. 4, 2006, now abandoned, which is a continuation of application No. 11/108,812, filed on Apr. 19, 2005, now Pat. No. 7,156,757, which is a continuation of application No. 10/784,744, filed on Feb. 24, 2004, now Pat. No. 6,913,550, which is a continuation of application No. 10/096,852, filed on Mar. 14, 2002, now Pat. No. 6,729,976, which is a continuation-in-part of application No. 09/989,191, filed on Nov. 21, 2001, now Pat. No. 6,796,912, and a continuation-in-part of application No. 09/404,164, filed on Sep. 27, 1999, now Pat. No. 6,358,161, which is a division of application No. 08/922,633, filed on Sep. 3, 1997, now Pat. No. 5,957,786.

(51) Int. Cl.
*A63B 37/12* (2006.01)

(52) U.S. Cl. ..... 473/383
(58) Field of Classification Search ..... 473/383–385
See application file for complete search history.

(56) References Cited

U.S. PATENT DOCUMENTS

| | | | | |
|---|---|---|---|---|
| 4,560,168 | A | 12/1985 | Aoyama | 273/232 |
| 4,681,323 | A | 7/1987 | Alaki et al. | 473/384 |
| 4,729,861 | A | 3/1988 | Lynch et al. | 264/219 |
| 4,915,390 | A | 4/1990 | Gobush et al. | 273/232 |
| 4,925,193 | A | 5/1990 | Melvin et al. | 273/232 |
| 4,991,852 | A | 2/1991 | Pattison | 273/232 |
| 5,018,741 | A | 5/1991 | Stiefel et al. | 273/232 |
| D318,507 | S | 7/1991 | Gobush et al. | D21/205 |
| D318,508 | S | 7/1991 | Gobush et al. | D21/205 |
| D320,828 | S | 10/1991 | Gobush et al. | D21/205 |
| D320,829 | S | 10/1991 | Gobush et al. | D21/205 |
| D321,231 | S | 10/1991 | Gobush et al. | D21/205 |
| 5,060,953 | A | 10/1991 | Bunger et al. | 473/384 |
| 5,060,954 | A | 10/1991 | Gobush | 473/378 |
| 5,092,604 | A | 3/1992 | Oka | 473/384 |
| D327,519 | S | 6/1992 | Gobush et al. | D21/205 |
| D336,755 | S | 6/1993 | Pelletier | D21/205 |
| D340,488 | S | 10/1993 | Aoyama | D21/205 |
| 5,249,804 | A | 10/1993 | Sanchez | 273/232 |

(Continued)

*Primary Examiner*—Raeann Trimiew
(74) *Attorney, Agent, or Firm*—Hanify & King, P.C.

(57) ABSTRACT

A golf ball having an outside surface with a plurality of dimples formed thereon. The dimples on the ball have a cross-sectional profiles formed by a catenary curve. Combinations of varying dimple diameters, shape factors, and chordal depths in the catenary curve are used to vary the ball flight performance according to ball spin characteristics, player swing speed, as well as satisfy specific aerodynamic magnitude and direction criteria.

19 Claims, 22 Drawing Sheets

U.S. PATENT DOCUMENTS

| | | | | |
|---|---|---|---|---|
| 5,273,287 | A | 12/1993 | Molitor et al. | 473/384 |
| D349,141 | S | 7/1994 | Pelletier et al. | D21/205 |
| D359,993 | S | 7/1995 | Pelletier et al. | D21/205 |
| D364,904 | S | 12/1995 | Pelletier et al. | D21/205 |
| 5,562,552 | A | 10/1996 | Thurman | 473/379 |
| 5,575,477 | A | 11/1996 | Hwang | 473/379 |
| 5,586,951 | A | 12/1996 | Sugiura | 473/379 |
| 5,682,230 | A | 10/1997 | Anfinsen et al. | 356/28 |
| 5,688,191 | A | 11/1997 | Cavallaro et al. | 473/373 |
| 5,688,194 | A | 11/1997 | Stiefel et al. | 473/383 |
| 5,702,312 | A | 12/1997 | Horiuchi et al. | 473/377 |
| 5,713,801 | A | 2/1998 | Aoyama | 473/354 |
| 5,803,831 | A | 9/1998 | Sullivan et al. | 473/374 |
| 5,885,172 | A | 3/1999 | Hebert et al. | 473/354 |
| 5,919,100 | A | 7/1999 | Boehm et al. | 473/354 |
| 5,935,023 | A | 8/1999 | Maehara et al. | 473/384 |
| 5,957,786 | A | 9/1999 | Aoyama | 473/379 |
| 5,957,787 | A | 9/1999 | Hwang | 473/379 |
| 5,965,669 | A | 10/1999 | Cavallaro et al. | 525/221 |
| 5,981,654 | A | 11/1999 | Rajagopalan | 525/66 |
| 5,981,658 | A | 11/1999 | Rajagopalan et al. | 525/72 |
| 6,149,535 | A | 11/2000 | Bissonnette et al. | 473/354 |
| 6,186,002 | B1 | 2/2001 | Lieberman et al. | 73/432.1 |
| 6,213,898 | B1 | 4/2001 | Ogg | 473/383 |
| 6,285,445 | B1 | 9/2001 | Winfield et al. | 356/28 |
| 6,290,615 | B1 | 9/2001 | Ogg | 473/378 |
| 6,331,150 | B1 | 12/2001 | Ogg | 473/383 |
| 6,338,684 | B1 | 1/2002 | Winfield et al. | 473/378 |
| 6,511,389 | B2 | 1/2003 | Ogg | 473/383 |
| 6,729,976 | B2 | 5/2004 | Bissonnette et al. | 473/383 |
| 6,796,912 | B2 * | 9/2004 | Dalton et al. | 473/383 |
| 6,913,550 | B2 | 7/2005 | Bissonnette et al. | 473/383 |
| 6,969,327 | B2 | 11/2005 | Aoyama et al. | 473/383 |
| 7,156,757 | B2 | 1/2007 | Bissonnette et al. | 473/383 |
| 7,258,632 | B2 | 8/2007 | Aoyama et al. | 473/383 |
| 2001/0009310 | A1 | 7/2001 | Hebert et al. | |
| 2002/0123390 | A1 | 9/2002 | Byrne et al. | |
| 2002/0123395 | A1 | 9/2002 | Murphy et al. | |

* cited by examiner $D_A < D_B \leq D_C \leq D_D \leq D_E$

80% $D_A$, $D_B$, $D_C$, $D_D$, $D_E$ >0.11"

DIMP. AREA > 80%

$$D_A < D_B \leq D_C \leq D_D \leq D_E$$

GOLF BALL DIMPLES WITH A CATENARY CURVE PROFILE

CROSS-REFERENCE TO RELATED APPLICATIONS

This application is a continuation-in-part of U.S. application Ser. No. 11/907,195, filed Oct. 10, 2007 now U.S. Pat. No. 7,491,137, which is a continuation of U.S. patent application Ser. No. 11/607,916, filed Dec. 04, 2006 now abandoned, which is a continuation of U.S. patent application Ser. No. 11/108,812, filed Apr. 19, 2005 now U.S. Pat. No. 7,156,757, which is a continuation of U.S. patent application Ser. No. 10/784,744, filed Feb. 24, 2004, now U.S. Pat. No. 6,913,550, which is a continuation of U.S. patent application Ser. No. 10/096,852, filed Mar. 14, 2002, now U.S. Pat. No. 6,729,976, which is a continuation-in-part of U.S. patent application Ser. No. 09/989,191, filed Nov. 21, 2001, now U.S. Pat. No. 6,796,912, and also a continuation-in-part of U.S. patent application Ser. No. 09/404,164, filed Sep. 27, 1999, now U.S. Pat. No. 6,358,161, which is a divisional of U.S. patent application Ser. No. 08/922,633, filed Sep. 3, 1997, now U.S. Pat. No. 5,957,786. The entire disclosures of the related applications are incorporated by reference herein.

FIELD OF INVENTION

The present invention relates to golf balls having improved aerodynamic characteristics that yield improved flight performance and longer ball flight. The improved aerodynamic characteristics are obtained through the use of specific dimple arrangements and dimple profiles. In particular, the invention relates to a dimple pattern including dimples having a cross-sectional profile defined by a mathematical function based on a catenary curve. The use of such a cross-sectional profile provides improved means to control dimple shape, volume, and transition to a spherical golf ball surface. The aerodynamic improvements are applicable to golf balls of any size and weight.

BACKGROUND OF THE INVENTION

The flight of a golf ball is determined by many factors. The majority of the properties that determine flight are outside of the control of the golfer. While a golfer can control the speed, the launch angle, and the spin rate of a golf ball by hitting the ball with a particular club, the final resting point of the ball depends upon golf ball construction and materials, as well as environmental conditions, e.g., terrain and weather. Since flight distance and consistency are critical factor in reducing golf scores, manufacturers continually strive to make even the slightest incremental improvements in golf ball flight consistency and flight distance, e.g., one or more yards, through various aerodynamic properties and golf ball constructions. For example, golf balls were originally made with smooth outer surfaces. However, in the late nineteenth century, players observed that, as golf balls became scuffed or marred from play, the balls achieved more distance. As such, players then began to roughen the surface of new golf balls with a hammer to increase flight distance.

Manufacturers soon caught on and began molding non-smooth outer surfaces on golf balls. By the mid 1900's, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which had 384 dimples that were arranged in an icosahedral pattern resulting in about 76 percent coverage of the ball surface. The dimpled golf balls used today travel nearly two times farther than a similar ball without dimples.

These improvements have come at great cost to manufacturers. In fact, historically manufacturers improved flight performance via iterative testing, where golf balls with numerous dimple patterns and dimple profiles are produced and tested using mechanical golfers. Flight performance is characterized in these tests by measuring the landing position of the various ball designs. For example, to determine if a particular ball design has desirable flight characteristics for a broad range of players, i.e., high and low swing speed players, manufacturers perform the mechanical golfer test with different ball launch conditions, which involves immense time and financial commitments. Furthermore, it is difficult to identify incremental performance improvements using these methods due to the statistical noise generated by environmental conditions, which necessitates large sample sizes for sufficient confidence intervals.

Another more precise method of determining specific dimple arrangements and dimple shapes, that result in an aerodynamic advantage, involves the direct measurement of aerodynamic characteristics as opposed to ball landing positions. These aerodynamic characteristics define the forces acting upon the golf ball throughout flight.

Aerodynamic forces acting on a golf ball are typically resolved into orthogonal components of lift ($F_L$) and drag ($F_D$). FIG. 1 shows the various forces acting on a golf ball in flight. Lift is defined as the aerodynamic force component acting perpendicular to the flight path. It results from a difference in pressure that is created by a distortion in the air flow that results from the back spin of the ball. A boundary layer forms at the stagnation point of the ball, B, then grows and separates at points S1 and S2, as shown in FIG. 2. Due to the ball backspin, the top of the ball moves in the direction of the airflow, which retards the separation of the boundary layer. In contrast, the bottom of the ball moves against the direction of airflow, thus advancing the separation of the boundary layer at the bottom of the ball. Therefore, the position of separation of the boundary layer at the top of the ball, S1, is further back than the position of separation of the boundary layer at the bottom of the ball, S2. This asymmetrical separation creates an arch in the flow pattern, requiring the air over the top of the ball to move faster and, thus, have lower pressure than the air underneath the ball.

Drag is defined as the aerodynamic force component acting parallel to the ball flight direction. As the ball travels through the air, the air surrounding the ball has different velocities and, accordingly, different pressures. The air exerts maximum pressure at the stagnation point, B, on the front of the ball, as shown in FIG. 2. The air then flows over the sides of the ball and has increased velocity and reduced pressure. The air separates from the surface of the ball at points S1 and S2, leaving a large turbulent flow area with low pressure, i.e., the wake. The difference between the high pressure in front of the ball and the low pressure behind the ball reduces the ball speed and acts as the primary source of drag for a golf ball.

The dimples on a golf ball are important in reducing drag and increasing lift. For example, the dimples on a golf ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Based on the role that dimples play in reducing drag on a golf ball, golf ball manufacturers continually seek dimple patterns that increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators.

In addition to researching dimple pattern and size, golf ball manufacturers also study the effect of dimple shape, volume, and cross-section on overall flight performance of the ball. One example is U.S. Pat. No. 5,735,757, which discusses making dimples using two different spherical radii with an "inflection point" where the two curves meet. In most cases, however, the cross-sectional profiles of dimples in prior art golf balls are spherical, parabolic, elliptical, semi-spherical curves, saucer-shaped, a sine curve, a truncated cone, or a flattened trapezoid. One disadvantage of these shapes is that they can sharply intrude into the surface of the ball, which may cause the drag to become excessive. As a result, the ball may not make best use of momentum initially imparted thereto, resulting in an insufficient carry of the ball.

Further, the most commonly used spherical profile is essentially a function of two parameters: diameter and depth (chordal or surface). While edge angle, which is a measure of the steepness of the dimple wall where it abuts the ball surface, is often discussed when describing these types of profiles, edge angle generally cannot be varied independently of depth unless dual radius profiles are employed. The cross sections of dual radius dimple profiles are generally defined by two circular arcs: the first arc defines the outer part of the dimple and the second arc defines the central part of the profile. The radii are typically larger in the center, which produces a saucer shaped dimple where the steepness of the walls (and, thus, the edge angle) may be varied independently of the dimple depth and diameter. While effective, this profile is described by a number of equations that at least require first order continuity for tangency between the arcs, as well as varying dimple diameter and depth values to achieve the desired dimple shape.

In addition to the profiles discussed above, dimple patterns have been employed in an effort to control and/or adjust the aerodynamic forces acting on a golf ball. For example, U.S. Pat. Nos. 6,213,898 and 6,290,615 disclose golf ball dimple patterns that reduce high-speed drag and increase low speed lift. It has now been discovered, however, contrary to the disclosures of these patents, that reduced high-speed drag and increased low speed lift does not necessarily result in improved flight performance. For example, excessive high-speed lift or excessive low-speed drag may result in undesirable flight performance characteristics. The prior art is silent, however, as to aerodynamic features that influence other aspects of golf ball flight, such as flight consistency, as well as enhanced aerodynamic coefficients for balls of varying size and weight.

Thus, there remains a need to optimize the aerodynamics of a golf ball to improve flight distance and consistency. Further, there is a need to develop dimple arrangements and profiles that result in longer distance and more consistent flights regardless of the swing-speed of a player, the orientation of the ball when impacted, or the physical properties of the ball being played. The use of catenary dimple profiles is considered one way to achieve these objectives.

SUMMARY OF THE INVENTION

The present invention is directed to a golf ball having a plurality of recessed dimples on the surface thereof, wherein at least a portion of the plurality of recessed dimples have a profile defined by the revolution of a catenary curve according to the following function:

$$y = \frac{d_c(\cosh(sf * x) - 1}{\cosh\left(sf * \frac{D}{2}\right) - 1}$$

wherein y is the vertical direction coordinate away from the center of the ball with 0 at the center of the dimple;

x is the horizontal (radial) direction coordinate from the dimple apex to the dimple surface with 0 at the center of the dimple;

sf is a shape factor;

$d_c$ is the chordal depth of the dimple; and

D is the diameter of the dimple.

In one embodiment, about 50 percent or more of the dimples on the golf ball are defined by the catenary curve expression above. In another embodiment, about 80 percent or more of the dimples on the golf ball are defined by the catenary curve expression. In this aspect of the invention, D may range from about 0.100 inches to about 0.225 inches, sf from about 5 to about 200, and $d_c$ from about 0.002 inches to about 0.008 inches. For example, D may be from about 0.115 inches to about 0.185 inches, sf from about 10 to about 100 or from about 10 to about 75, and $d_c$ from about 0.004 inches to about 0.006 inches. In one embodiment, D is from about 0.115 inches to about 0.185 inches, sf is from about 10 to 100, and $d_c$ is from about 0.004 inches to about 0.006 inches.

The golf ball may also include a plurality of dimples having an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, wherein $C_L$ is a lift coefficient and $C_D$ is a drag coefficient, wherein the golf ball includes: a first aerodynamic coefficient magnitude between about 0.24 and about 0.29 and a first aerodynamic force angle between about 32 degrees and about 39 degrees at a Reynolds Number of about 230000 and a spin ratio of about 0.080; and a second aerodynamic coefficient magnitude between about 0.24 and about 0.29 and a second aerodynamic force angle between about 33 degrees and about 41 degrees at a Reynolds Number of about 208000 and a spin ratio of about 0.090.

In this regard, the golf ball may also include a third aerodynamic coefficient magnitude between about 0.25 and about 0.30 and a third aerodynamic force angle between about 34 degrees and about 42 degrees at a Reynolds Number of about 190000 and a spin ratio of about 0.10; and a fourth aerodynamic coefficient magnitude between about 0.25 and about 0.31 and a fourth aerodynamic force angle between about 35 degrees and about 43 degrees at a Reynolds Number of about 170000 and a spin ratio of about 0.11.

BRIEF DESCRIPTION OF THE DRAWINGS

These and other aspects of the present invention may be more fully understood with reference to, but not limited by, the following drawings.

FIG. 3 is a graphical interpretation of a catenary curve with different values of the parameter a.

DETAILED DESCRIPTION OF THE INVENTION

The present invention is directed to golf balls having improved aerodynamic performance due, at least in part, to the selection of dimple arrangements and dimple profiles. In particular, the present invention is directed to a golf ball that includes at least a portion of its dimples that are defined by the revolution of a catenary curve about an axis.

The dimple profiles of the present invention may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers. Examples of these and other types of ball constructions that may be used with the present invention include those described in U.S. Pat. Nos. 5,713,801, 5,803,831, 5,885,172, 5,919,100, 5,965,669, 5,981,654, 5,981,658, and 6,149,535, as well as in Publication No. US2001/0009310 A1.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

After selecting the desired ball construction, the flight performance of the golf ball can be adjusted according to the design, placement, and number of dimples on the ball. As explained in greater detail below, the use of catenary curves provides a relatively effective way to modify the ball flight performance without significantly altering the dimple pattern and, thus, allow greater flexibility to ball designers to better customize a golf ball to suit a player.

Dimple Profiles of the Invention

Figure 1:
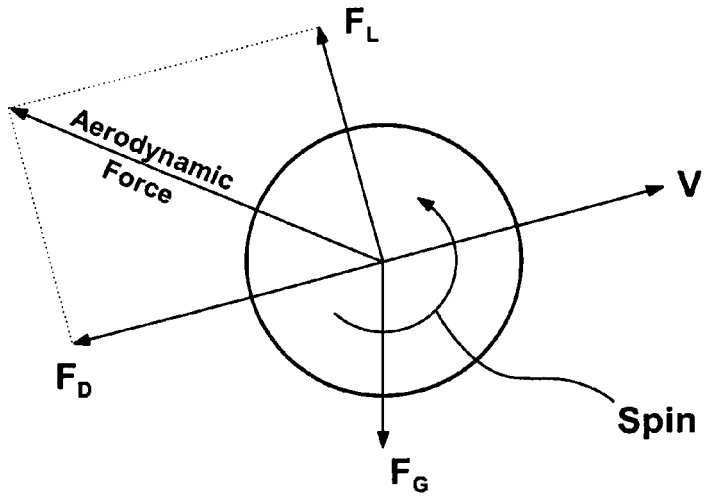
FIG. 1 is an illustration of the forces acting on a golf ball in flight.
Figure 2:
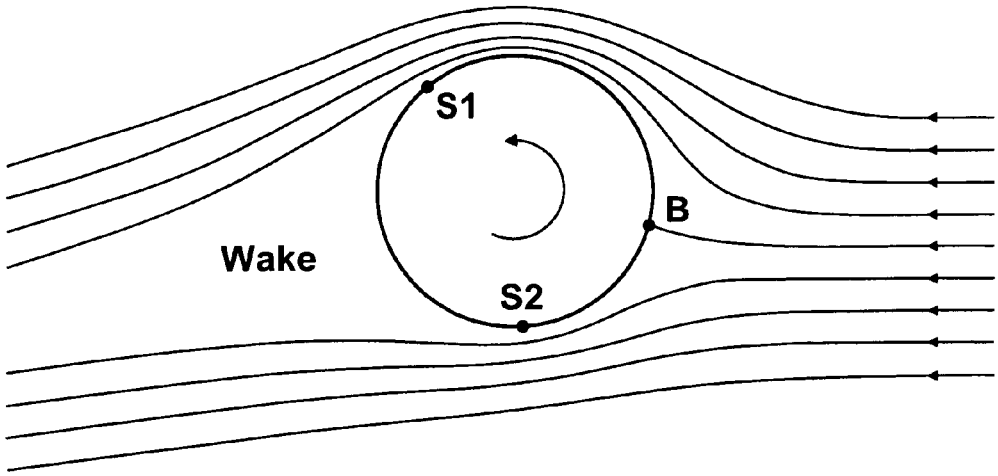
FIG. 2 is an illustration of the air flow around a golf ball in flight.
Figure 3:
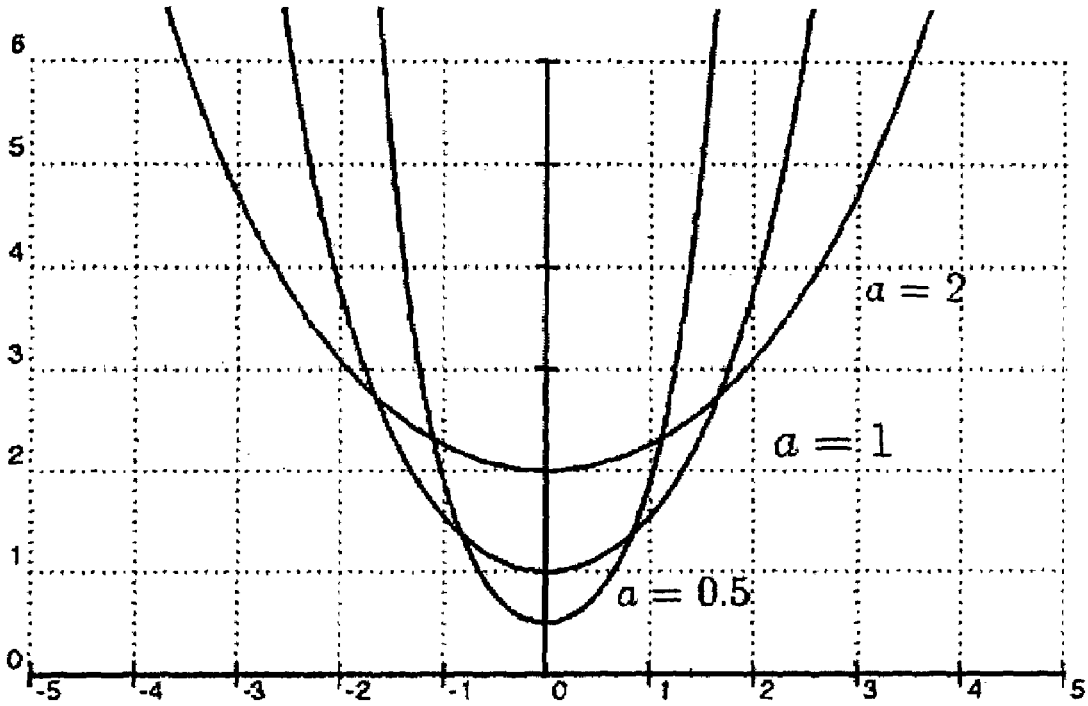

A catenary curve represents the assumed shape of a perfectly flexible, uniformly dense, and inextensible chain suspended from its endpoints. In general, the mathematical formula representing such a curve is expressed as equation (1):

$$y = a\cosh\left(\frac{x}{a}\right) \tag{1}$$

where a is a constant in terms of horizontal tension in the chain and its weight per unit length, y is the vertical axis and x is the horizontal axis in a two dimensional Cartesian space. The chain is steepest near the points of suspension because this part of the chain has the most weight pulling down on it. Toward the bottom, the slope of the chain decreases because the chain is supporting less weight. FIG. 3 generally demonstrates the concept of a catenary curve with different values of the parameter a.

The present invention is directed to defining dimples on a golf ball by revolving a catenary curve about its y axis. In particular, the catenary curve used to define a golf ball dimple is a hyperbolic cosine function in the form of:

$$y = \frac{d_c(\cosh(sf * x) - 1)}{\cosh\left(sf * \frac{D}{2}\right) - 1} \tag{2}$$

where: y is the vertical direction coordinate with 0 at the bottom of the dimple and positive upward (away from the center of the ball);

x is the horizontal (radial) direction coordinate, with 0 at the center of the dimple sf is a shape constant (also called shape factor);

$d_c$ is the chordal depth of the dimple; and

D is the diameter of the dimple.

Unlike the dual radius dimple profile discussed previously, the inventive dimple profiles based on catenary curves are defined by a single continuous, differentiable function having independent variables of dimple diameter, depth, and shape factor (relative curvature and edge angle). Thus, the dimple profiles of the present invention can have any combination of diameter, depth, and edge angle with no additional requirements on derivatives of the function used to define the dimple profile.

The "shape constant" or "shape factor", sf, is an independent variable in the mathematical expressions described above for a catenary curve. The use of a shape factor in the present invention provides an expedient method of generating alternative dimple profiles, for dimples with fixed radii and depth. For example, the shape factor may be used to independently alter the volume ratio ($V_r$) of the dimple while holding the dimple depth and radius fixed. The volume ratio is the ratio of the chordal dimple volume (bounded by the dimple surface and its chord plane divided by the volume of a cylinder defined by a similar diameter and chordal depth as the dimple). Accordingly, if a golf ball designer desires to generate balls with alternative lift and drag characteristics for a particular dimple position, diameter, and depth, then the golf ball designer may simply describe alternative shape factors to obtain alternative lift and drag performance without having to change these other parameters. No modification to the dimple layout on the surface of the ball is required.

Similar changes in the volume ratio and aerodynamic performance may be accomplished by using alternate forms of the equation (2) above to define the catenary dimple profile, see, e.g., equations (5), (6), (7), and (8) below.

While the present invention is directed toward using a catenary curve for at least a portion of the dimples on a golf ball, it is not necessary that catenary curves be used on every dimple on a golf ball. In some cases, the use of a catenary curve may only be used for a small number of dimples. Alternatively, a large amount of dimples may have profiles based on a catenary curve. In general, it is preferred that a sufficient number of dimples on the ball have catenary curves so that variation of shape factors will allow a designer to alter the flight characteristics of the ball. Thus, in one embodiment, at least about 30 percent, preferably about 50 percent, and more preferably at least about 60 percent, of the dimples on a golf ball are defined by a catenary curve.

Accordingly, the present invention uses variations of equation (2) to define the cross-section of at least a portion of the dimples on a golf ball. For example, the catenary curve can be defined by hyperbolic sine or cosine functions, ratios of these functions or combinations of them. A hyperbolic sine function is defined by the following expression:

$$\sinh(x) = \frac{e^x - e^{-x}}{2} \tag{3}$$

while a hyperbolic cosine function is defined by the following expression:

$$\cosh(x) = \frac{e^x + e^{-x}}{2}. \tag{4}$$

In one embodiment of the present invention, the mathematical equation for describing the cross-sectional profile of a dimple is expressed using the above expression by the following formula:

$$y = \frac{d_c(e^{(sfx)} + e^{-(sfx)} - 2}{e^{\left(sf\frac{D}{2}\right)} + e^{-\left(sf\frac{D}{2}\right)} - 2} \tag{5}$$

where: y is the vertical direction coordinate with 0 at the bottom of the dimple and positive upward (away from the center of the ball);

x is the horizontal (radial) direction coordinate, with 0 at the center of the dimple;

sf is a shape factor;

$d_c$ is the chordal depth of the dimple; and

D is the diameter of the dimple.

An alternate embodiment of the present invention involves a mathematical expression in terms of hyperbolic sine using the following formula:

$$y = \frac{d_c\left(\sqrt{1 + \sinh^2(sf * x)} - 1\right)}{\sqrt{1 + \sinh^2\left(sf * \frac{D}{2}\right) - 1}} \tag{6}$$

where y, x, sf, $d_c$, and D are defined as shown above.

In another embodiment of the present invention, a mathematical expression is shown as terms of a series expansion of one of the previous embodiments. However, the formula is preferably restricted to small values of sf, e.g., where sf is less than or equal to about 50. The equation describing the cross-sectional profile is expressed by the following formula:

$$y = \frac{d_c sf^2}{2\left(\cosh\left(sf\frac{D}{2}\right) - 1\right.} * x^2 + \frac{d_c sf^4}{24\left(\cosh\left(sf\frac{D}{2}\right) - 1\right.} * x^4 \tag{7}$$

Again y, x, sf, $d_c$, and D are defined as shown above.

Figure 4:
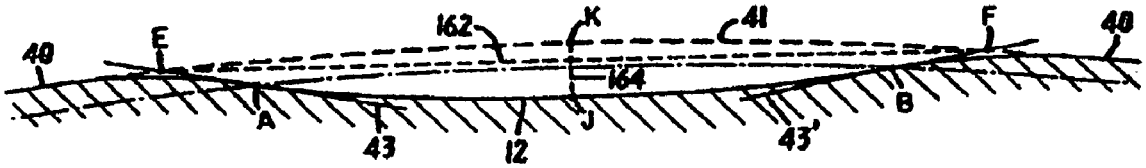
FIG. 4 shows a method for measuring the depth, diameter (twice the radius), and edge angle of a dimple.
Figure 5:
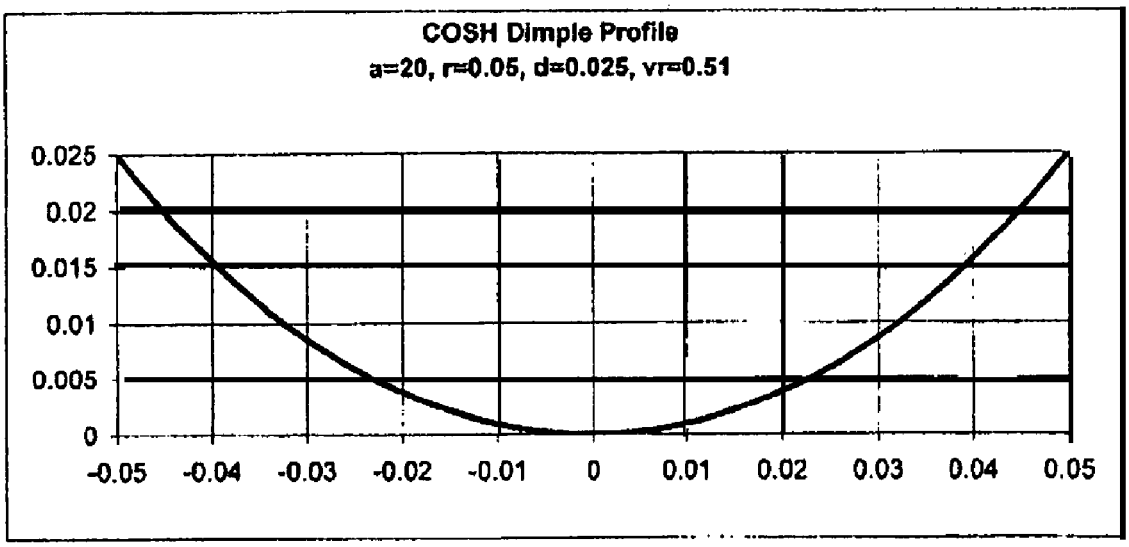
FIG. 5 is a dimple cross-sectional profile defined by a hyperbolic cosine function, cosh, with a shape constant of 20, a dimple depth of 0.025 inches, a dimple radius of 0.05 inches, and a volume ratio of 0.51.
Figure 6:
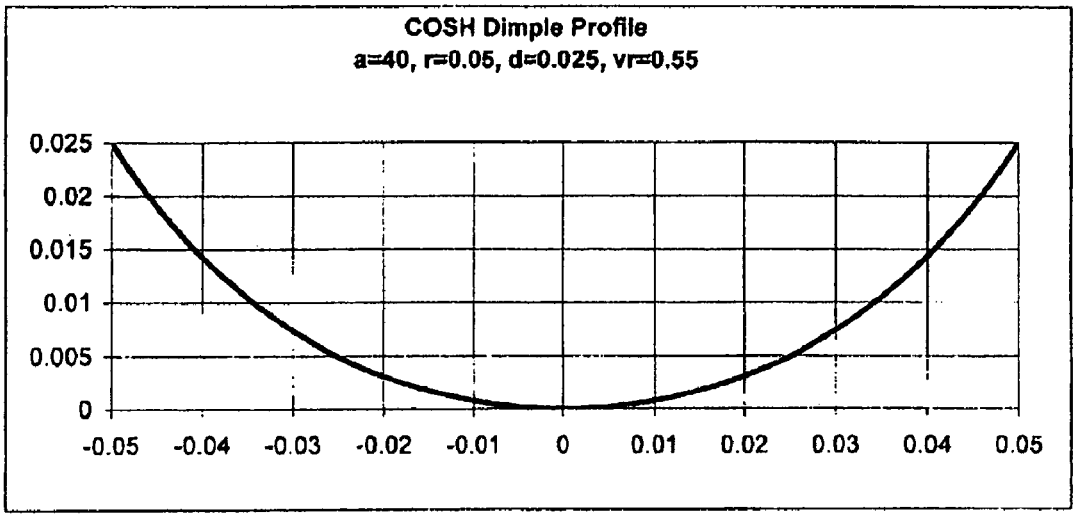
FIG. 6 is a dimple cross-sectional profile defined by a hyperbolic cosine function, cosh, with a shape constant of 40, a dimple depth of 0.025 inches, a dimple radius of 0.05 inches, and a volume ratio of 0.55.
Figure 7:
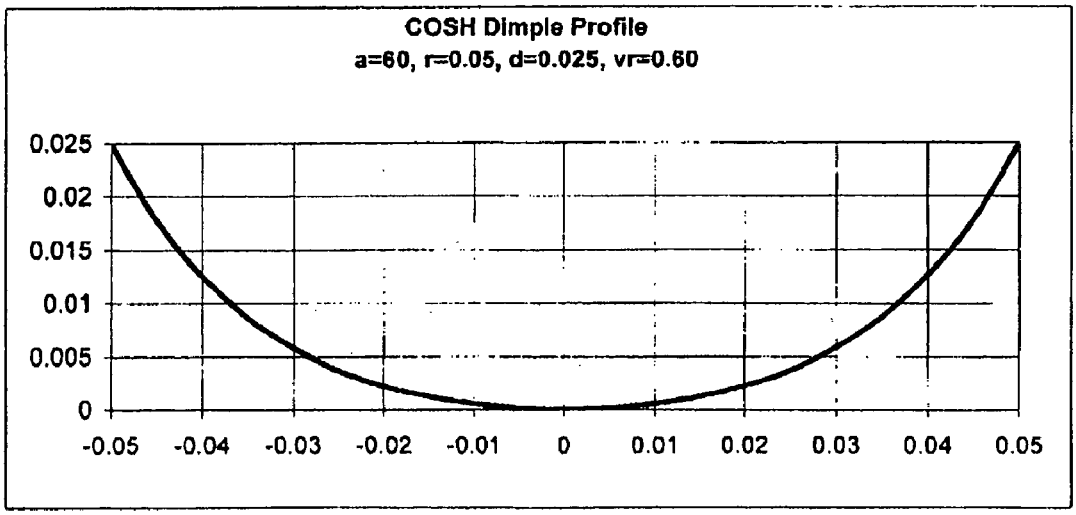
FIG. 7 is a dimple cross-sectional profile defined by a hyperbolic cosine function, cosh, with a shape constant of 60, a dimple depth of 0.025 inches, a dimple radius of 0.05 inches, and a volume ratio of 0.60.
Figure 8:
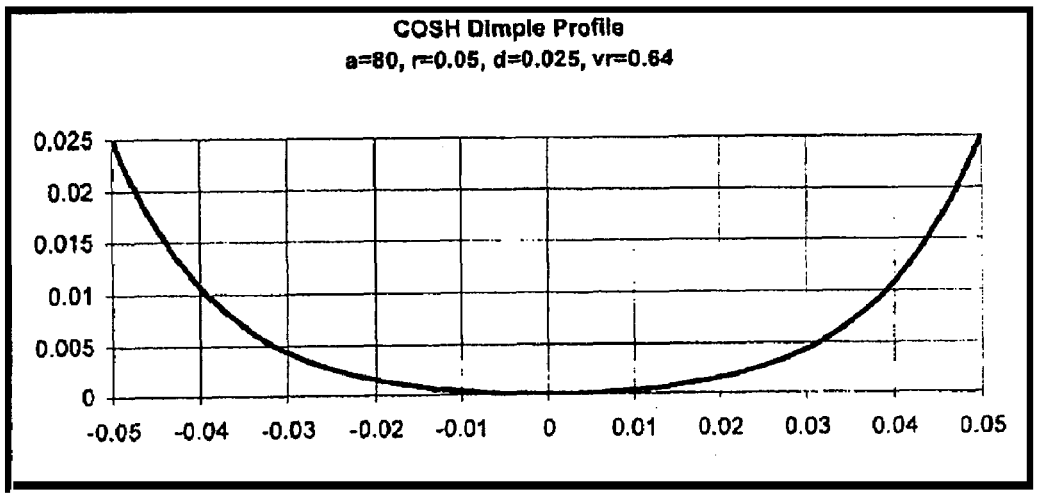
FIG. 8 is a dimple cross-sectional profile defined by a hyperbolic cosine function, cosh, with a shape constant of 80, a dimple depth of 0.025 inches, a dimple radius of 0.05 inches, and a volume ratio of 0.64.
Figure 9:
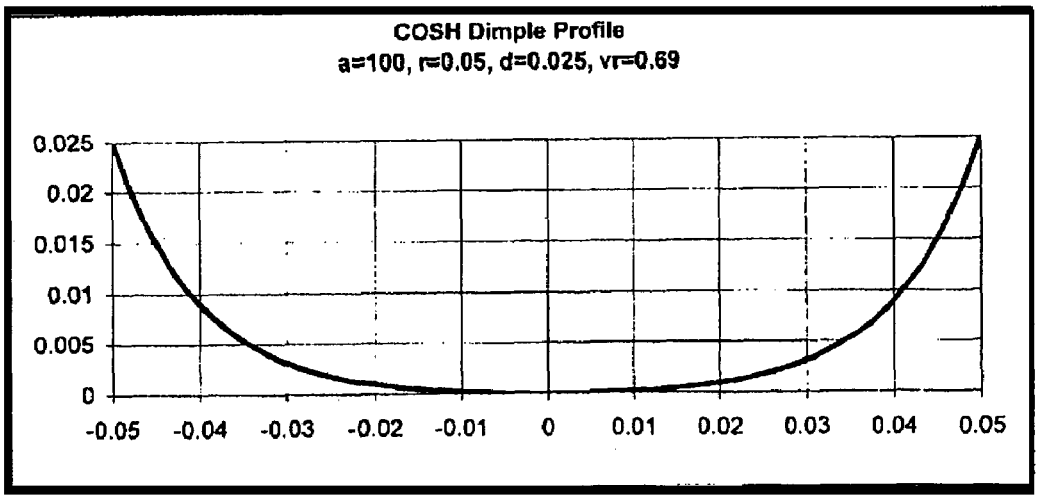
FIG. 9 is a dimple cross-sectional profile defined by a hyperbolic cosine function, cosh, with a shape constant of 100, a dimple depth of 0.025 inches, a dimple radius of 0.05 inches, and a volume ratio of 0.69.

The depth ($d_c$) and diameter (D) of the dimple may be measured as shown in FIG. 4.

It is understood that, based on the equations and disclosure herein, one skilled in the art would be able to derive other expressions illustrating catenary dimple profiles relating diameter, chord or surface depth, and shape factor. Therefore, the present invention is not limited to the example equations discussed above; rather, the present invention encompasses other expressions illustrating catenary dimple profiles relating diameter, chord or surface depth, and shape factor.

In yet another embodiment of the present invention, the mathematical equation for describing the cross-sectional profile of a dimple is expressed by the following formula:

$$y = \frac{d_c(\cosh(sf * x) - 1)}{\cosh(sf * r) - 1} \quad (8)$$

where: y is the vertical direction coordinate with 0 at the bottom of the dimple and positive upward (away from the center of the ball);

x is the horizontal (radial) direction coordinate, with 0 at the center of the dimple;

sf is a shape constant (also called shape factor);

d is the depth of the dimple from the phantom ball surface; and r is the radius of the dimple.

The depth (d) and radius (r) (r=½ diameter (D)) of the dimple may be measured as described in U.S. Pat. No. 4,729,861 (shown in FIG. 4), the disclosure of which is incorporated by reference in its entirety. The depth (d) is measured from point J to point K on the ball phantom surface 41, and the diameter (D) is measured between the dimple edge points E and F. Although FIG. 4 is meant to depict a dimple of conventional spherical shape, the described methods for measuring dimple dimensions are also applicable to the dimples of the present invention.

Some of the differences between equations (2) and (8) include the use of a) the chordal depth ($d_c$) in equation (2) as opposed to the depth from phantom surface d in equation (8) and b) the diameter D in equation (2) as opposed to the radius r in equation (8). Referring once again to FIG. 4, the chordal depth ($d_c$) is measured from point J to the chord line 162.

In addition, another difference between equations (2) and (8) is that computed volume ratios ($V_r$) will be different. For example, the volume ratios according to equation (8) will always be less than those computed for dimple profiles based on equation (2). However, it will be appreciated by those of ordinary skill in the art that the differences in the computed volume ratios based on the two equations are also dependent on the manner in which volume ratio is computed. In particular, if volume ratio is calculated as the ratio of total dimple volume to a cylinder based on surface depth, then volume ratio will vary for any changes in diameter, chordal depth, and shape factor. On the other hand, if volume ratio is the ratio of dimple volume (up to the chord plane) to a cylinder based on chord depth, then the volume ratio will vary only with changes in diameter and shape factor. Regardless, the greatest differences in volume ratio when using equations (2) and (8) occur as diameter and shape factor increase and chordal depth decreases.

For the equations provided above, and more specifically equation (8), shape constant values that are larger than 1 result in dimple volume ratios greater than 0.5. Preferably, shape factors are between about 20 to about 100. FIGS. 5-9 illustrate dimple profiles for shape factors of 20, 40, 60, 80, and 100, respectively, generated using equation (8). Table 1 illustrates how the volume ratio changes for a dimple with a radius of 0.05 inches and a depth of 0.025 inches.

TABLE 1

| Shape Factor | Volume Ratio |
|---|---|
| 20 | 0.51 |
| 40 | 0.55 |
| 60 | 0.60 |
| 80 | 0.64 |
| 100 | 0.69 |

As shown above, increases in shape factor result in higher volume ratios for a given dimple radius and depth.

In this regard, dimple patterns that include dimple profiles based on equation (8) may be at least partially driven by a desired percentage of dimples in the pattern that have a certain volume ratio. For example, one pattern may include about 50 percent or more dimples with a volume ratio of about 0.50 or greater. In one embodiment, about 50 percent to about 80 percent of the dimples have a volume ratio of about 0.5 to about 0.60 and about 20 percent to about 50 percent have a volume ratio of about 0.64 or greater.

Figure 10:
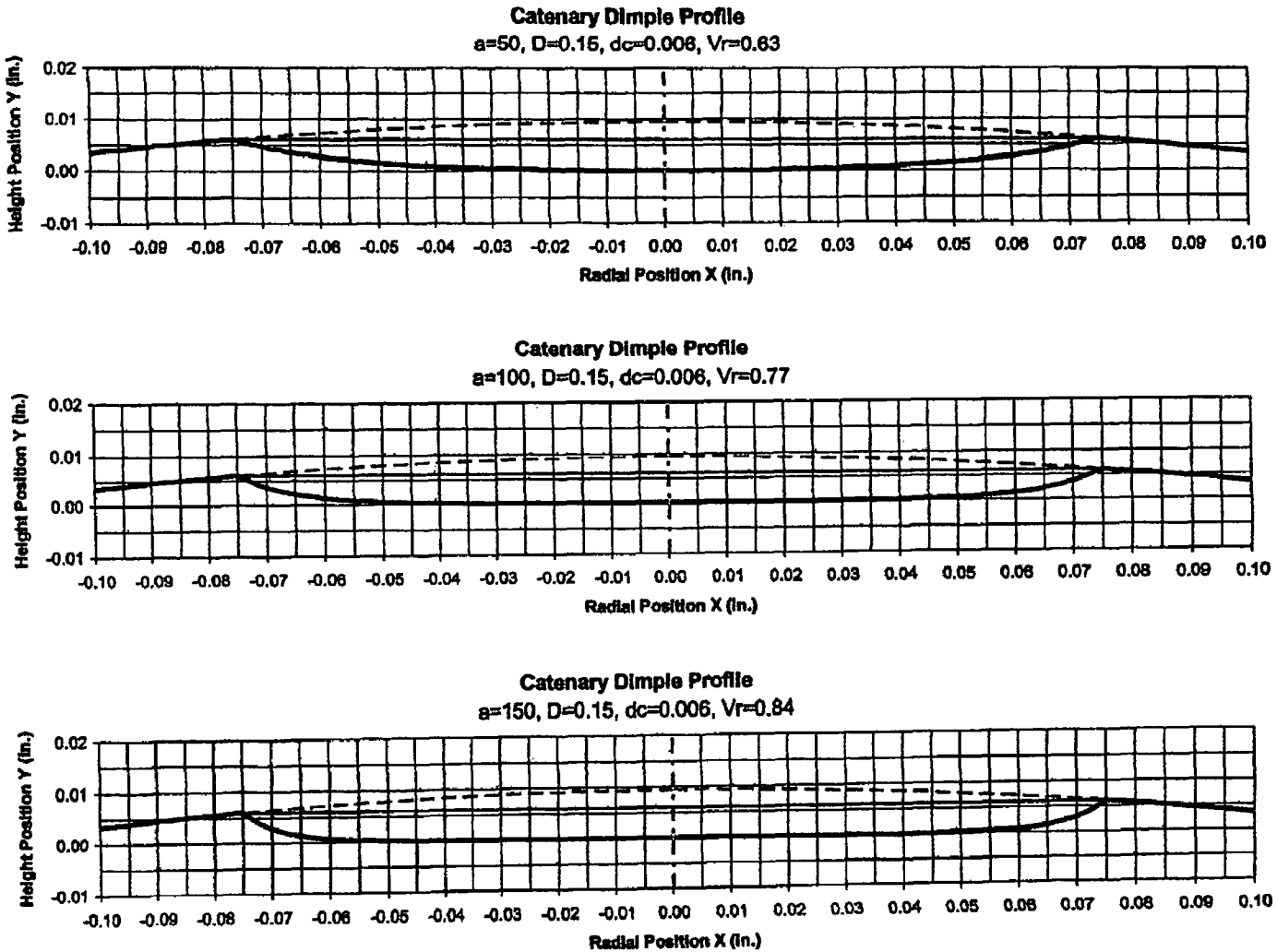
FIG. 10 illustrates dimple cross-sectional profiles that are defined by a hyperbolic cosine function, cosh, with varying shape constants, a dimple diameter of 0.150 inches, and a dimple chordal depth of 0.006 inches.

In contrast, many different but related shapes of dimples can be generated by manipulating the parameters of equation (2) and other expressions illustrating catenary dimple profiles relating diameter, chord or surface depth, and shape factor. For example, FIG. 10 shows catenary dimple profiles with varying shape factors (diameter and chordal depth are held constant). Table 3 illustrates the increase in volume ratio as shape factor increases from 50 to 150. In particular, an increase in shape factor from 50 to 150 results in an increase in volume ratio of about 133 percent.

TABLE 2

| Shape Factor | Diameter (in.) | Chordal Depth (in.) | Volume Ratio |
|---|---|---|---|
| 50 | 0.15 | 0.006 | 0.63 |
| 100 | | | 0.77 |
| 150 | | | 0.84 |

In addition, while not exactly correlative due to the differences between equations (2) and (8), the larger diameters and shallower depth used in FIG. 10 and Table 2 appear to increase the volume ratio. For example, when applied to equation (8), a shape factor of 100, a radius of 0.05 inches, and a depth of 0.025 inches results in a volume ratio of 0.69, whereas the same shape factor with a larger diameter, but shallower dimple profile based on equation (2) results in a volume ratio of 0.77. This is an example of one of number of differences between equations (2) and (8), i.e., the volume ratios computed for dimple profiles according to equation (2) are larger than the volume ratios computed for dimple profiles according to equation (8).

Figure 11:
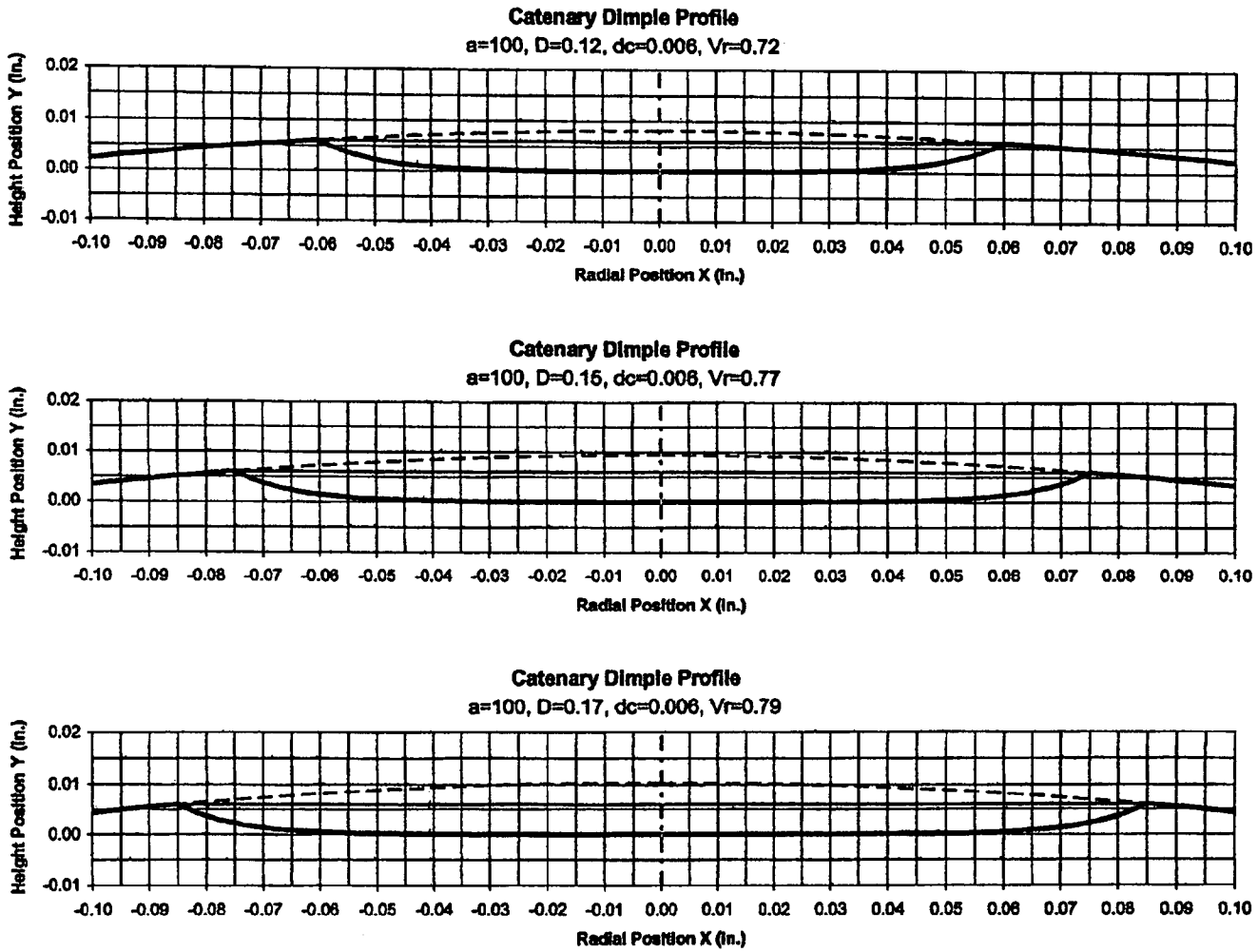
FIG. 11 illustrates dimple cross-sectional profiles that are defined by a hyperbolic cosine function, cosh, with varying dimple diameters, a shape factor of 100, and a dimple chordal depth of 0.006 inches.

FIG. 11 shows catenary dimple profiles with varying diameters (shape factor and chordal depth are held constant). Table 3 illustrates the increase in volume ratio with a corresponding increase in dimple diameter from 0.120 inches to 0.170 inches.

TABLE 3

| Diameter (in.) | Shape Factor | Chordal Depth (in.) | Volume Ratio |
|---|---|---|---|
| 0.120 | 100 | 0.006 | 0.72 |
| 0.150 | | | 0.77 |
| 0.170 | | | 0.79 |

Again, when comparing this result to the results above for equation (8), a larger diameter, shallower dimple profile results in a larger volume ratio at a shape factor of 100.

Figure 12:
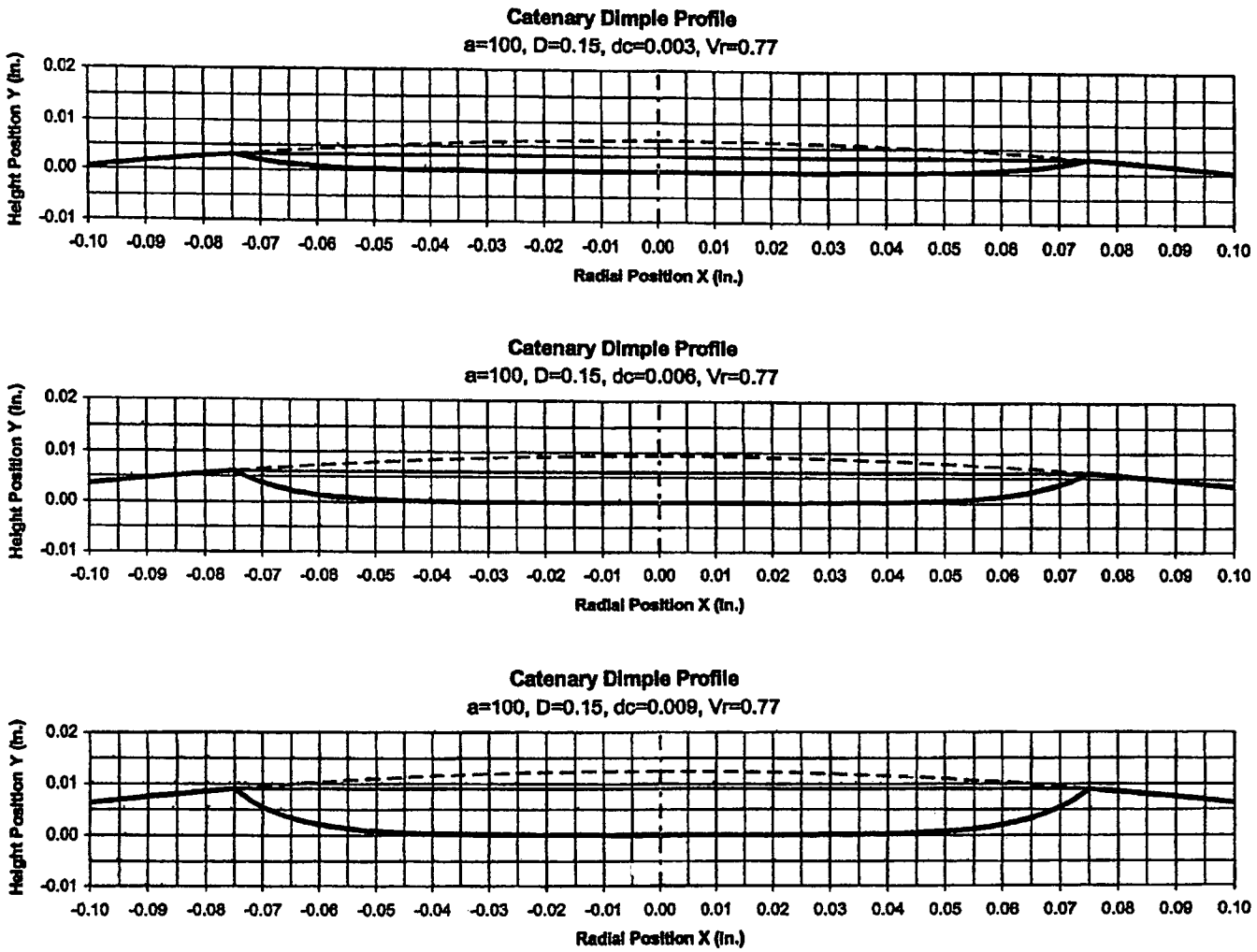
FIG. 12 illustrates dimple cross-sectional profiles that are defined by a hyperbolic cosine function, cosh, with varying dimple chordal depths, a shape factor of 100, and a dimple diameter of 0.150 inches.

In this aspect of the invention, when chordal depth is varied and shape factor and diameter is held constant (the diameter is still larger than previously used in equation (8), a larger volume ratio can be obtained when compared to the smaller, deeper dimples used above in equation (8). In particular, FIG. 12 and Table 4 illustrate that, with chordal depth ranging from 0.003 inches to 0.009 inches while the shape factor is held constant at 100 and the diameter is held constant at 0.15 inches, the volume ratio does not change, but it remains larger than the results shown in FIG. 10 and Table 1.

TABLE 4

| Chordal Depth (in.) | Shape Factor | Diameter (in.) | Volume Ratio |
|---|---|---|---|
| 0.003 | 100 | 0.150 | 0.77 |
| 0.006 | | | 0.77 |
| 0.009 | | | 0.77 |

Without being bound to any particular theory, it is believed that, when used with specific dimple counts, combinations of these three parameters produce optimal flight performance. In particular, specific ranges or combinations of dimple count, diameter, shape factor, and chordal depth (in accordance with equation (2)) are believed to produce optimal flight performance. For example, the number of dimples may range from about 250 to about 500. In one embodiment, the dimple count is from about 250 to about 450. In another embodiment, the dimple count is from about 250 to about 400. In still another embodiment, the number of dimples ranges from about 250 to about 350.

The diameter of the dimples may range from about 0.100 inches to about 0.225 inches. In one embodiment, the dimple diameter ranges from about 0.115 inches to about 0.200 inches. In another embodiment, the dimple diameter ranges from about 0.115 inches to about 0.185 inches. In yet another embodiment, the dimple diameter ranges from about 0.125 inches to about 0.185 inches.

As discussed briefly above, the use of a shape factor, in tandem with a cross-sectional profile based on the revolution of catenary curve according to equations (2) and (5)-(8), facilitate optimization of the flight profile of specific ball designs. As such, the shape factor may range from about 5 to about 200. In one embodiment, the shape factor ranges from about 10 to about 100. In another embodiment, the shape factor ranges from about 10 to about 75. In still another embodiment, the shape factor ranges from about 40 to about 150. In yet another embodiment, the shape factor is at least about 50.

The chordal depth of the dimple may range from about 0.002 inches to about 0.010 inches, preferably about 0.002 inches to about 0.008 inches. In one embodiment, the chordal depth is about 0.003 inches to about 0.009 inches. In another embodiment, the chordal depth is about 0.004 inches to about 0.006 inches.

It is clear from the tables above and associated figures that, when the dimple profile is based on equation (2), the volume ratio changes with changes in diameter and shape factor. In fact, as discussed previously, the volume ratio calculated for dimple profiles according to equation (2) will be larger than the volume ratio calculated for dimple profiles according to equation (8). In particular, shallow, large diameter dimples with profiles based on equation (2) results in a larger volume ratio as compared with dimples having more substantive depth and smaller diameters such as those based on equation (8) above.

Dimple profiles based on equation (2) with dimple diameters between about 0.100 inches and about 0.225 inches (or any range therebetween) and chordal depths between about 0.002 inches to about 0.008 inches (or any range therebetween) preferably have volume ratios at least about 0.60 or greater. In one embodiment, the volume ratio is about 0.63 or greater.

In another embodiment, the volume ratio is about 0.070 or greater. In still another embodiment, the volume ratio is about 0.72 or greater. For example, the volume ratio may be between about 0.63 to about 0.84.

In one embodiment, at least 50 percent of the dimples on the golf ball have a dimple profile based on equation (2). In another embodiment, at least about 80 percent of the dimples are based on equation (2). In still another embodiment, at least about 90 percent of the dimples are based on equation (2). In yet another embodiment, 100 percent of the dimples have a dimple profile according to equation (2).

Within these constraints, a portion of this percentage may be based on equation (2) with a fixed chordal depth and shape factor and varying diameters. For example, about 50 percent or more of the dimples having a dimple profile based on equation (2) may have a fixed chordal depth and shape factor and a varying diameter. In one embodiment, the diameter may range from about 0.100 to about 0.225, preferably about 0.115 inches to about 0.200 inches, more preferably about 0.115 inches to about 0.185 inches, and even more preferably about 0.125 inches to about 0.185 inches while the shape factor is constant and from about 5 to about 200, preferably about 10 to about 100, more preferably about 10 to about 75 and the chordal depth is constant and from about 0.002 inches to about 0.008 inches, preferably about 0.003 inches to about 0.006 inches, and more preferably about 0.004 inches to about 0.006 inches. The remaining dimples within the percentage of the dimples on the ball having a profile according to equation (2) may have varying chordal depth and/or shape factor within these ranges and a fixed diameter within the range of 0.100 inches to about 0.225 inches, preferably about 0.115 inches to about 0.200 inches, more preferably about 0.115 inches to about 0.185 inches, and even more preferably about 0.125 inches to about 0.185 inches.

One dimple pattern according to the invention has about 50 percent to about 100 percent of its dimples based on equation (2) with a varying diameter within the range of 0.125 inches to about 0.185 inches and a fixed chordal depth of about 0.004 inches to about 0.006 inches and a fixed shape factor between about 10 to about 75. If less than 100 percent of the dimples are based on equation (2), the remainder of the dimples may have cross-sectional profiles based on parabolic curves, ellipses, semi-spherical curves, saucer-shapes, sine curves, truncated cones, flattened trapezoids, or catenary curves according to equation (2) and/or equations (5)-(8).

For example, dimple patterns according to the present invention may be formed using a combination of equations (2) and (8). For example, in one embodiment, at least a portion of the dimples have a profile based on equation (2) and the remaining portion have dimple profiles based equation (8). In this aspect, about 5 percent to about 40 percent have dimple profiles based on equation (8) and about 60 percent to about 95 percent have dimple profiles based on equation (2). In another embodiment, about 5 percent to about 20 percent have dimple profiles based on equation (8) and about 80 percent to about 95 percent have dimple profiles based on equation (2).

The portion of the dimples having profiles based on equation (8) has a fixed radius and surface depth of 0.05 to about 0.09 inches and 0.005 to about 0.025 inches, respectively, with varying shape factors. For example, the shape factor may vary from 20 to 100. In one embodiment, the shape factor is at least about 40, but may vary up to 100. In fact, within the percentage of dimples having profiles based on equation (8), preferably about 50 percent or more have a shape factor of 50 or greater. While two or more shape factors may be used for dimples on a golf ball, it is preferred that the differences between the shape factors be relatively similar in order to achieve optimum ball flight performance that corresponds to a particular ball construction and player swing speed. In particular, a plurality of shape factors used to define dimples having catenary curves preferably do not differ by more than 30, and even more preferably do not differ by more than 15.

In this same scenario, the portion of the dimples based on equation (2) may have varying diameter, chordal depth, and shape factor. For example, within the percentage of dimples having a profile based on equation (2), at least 50 percent may have a fixed chordal depth and shape factor with a diameter ranging from about 0.100 to about 0.225, preferably about 0.115 inches to about 0.200 inches, more preferably about 0.115 inches to about 0.185 inches, and even more preferably about 0.125 inches to about 0.185 inches, while the remaining portion of these dimples are a mix of dimple profiles based on equation (2) holding diameter constant, while varying either the shape factor or chordal depth. In one embodiment, about 50 percent to about 80 percent of the dimples having a dimple profile based on equation (2) have a fixed chordal depth and shape factor with varying diameter and about 20 percent to about 50 percent are a mix of varying chordal depth with fixed diameter and fixed shape factor and varying shape factor with fixed diameter and chordal depth.

The use of a dimple shape factor in the catenary curve profiles of the present invention helps to yield particular optimal flight performance for specific swing speed categories. Again, the advantageous feature of shape factor is that dimple location need not be manipulated for each swing speed; only the dimple shape will be altered. Thus, a "family" of golf balls may have a similar general appearance although the dimple shape for at least a portion of the dimples on the ball is altered to optimize flight characteristics for particular swing speeds. Table 5 identifies certain beneficial shape factors for varying swing speeds, i.e., from 155-175 mph, from 140 to 155 mph, and from 125 to 140 mph, cover hardness, and ball compression.

TABLE 5

| Ball Design | Dimple Shape Factor | Ball Speed from driver (mph) | Cover Hardness (Shore D) | Ball Compression (Atti) |
|---|---|---|---|---|
| 1 | 80 | 155-175 | 45-55 | 60-75 |
| 2 | 90 | 155-175 | 45-55 | 75-90 |
| 3 | 100 | 155-175 | 45-55 | 90-105 |
| 4 | 70 | 155-175 | 55-65 | 60-75 |
| 5 | 80 | 155-175 | 55-65 | 75-90 |
| 6 | 90 | 155-175 | 55-65 | 90-105 |
| 7 | 55 | 155-175 | 65-75 | 60-75 |
| 8 | 65 | 155-175 | 65-75 | 75-90 |
| 9 | 75 | 155-175 | 65-75 | 90-105 |
| 10 | 65 | 140-155 | 45-55 | 60-75 |
| 11 | 75 | 140-155 | 45-55 | 75-90 |
| 12 | 85 | 140-155 | 45-55 | 90-105 |
| 13 | 55 | 140-155 | 55-65 | 60-75 |
| 14 | 65 | 140-155 | 55-65 | 75-90 |
| 15 | 75 | 140-155 | 55-65 | 90-105 |
| 16 | 40 | 140-155 | 65-75 | 60-75 |

TABLE 5-continued

| Ball Design | Dimple Shape Factor | Ball Speed from driver (mph) | Cover Hardness (Shore D) | Ball Compression (Atti) |
|---|---|---|---|---|
| 17 | 50 | 140-155 | 65-75 | 75-90 |
| 18 | 60 | 140-155 | 65-75 | 90-105 |
| 19 | 50 | 125-140 | 45-55 | 60-75 |
| 20 | 60 | 125-140 | 45-55 | 75-90 |
| 21 | 70 | 125-140 | 45-55 | 90-105 |
| 22 | 40 | 125-140 | 55-65 | 60-75 |
| 23 | 50 | 125-140 | 55-65 | 75-90 |
| 24 | 60 | 125-140 | 55-65 | 90-105 |
| 25 | 25 | 125-140 | 65-75 | 60-75 |
| 26 | 35 | 125-140 | 65-75 | 75-90 |
| 27 | 45 | 125-140 | 65-75 | 90-105 |

To illustrate the selection of shape factors in dimple design from Table 5, the preferred dimple shape factor for a ball having a cover hardness of about 45 to about 55 Shore D and a ball compression of about 60 to about 75 Atti for a player with a ball speed from the driver between about 140 and about 155 mph would be about 65. Likewise, the preferred shape factor for the same ball construction, but for a player having a ball speed from the driver of between about 155 mph and about 175 mph would be about 80. As mentioned above, these preferred shape factors may be adjusted upwards or downwards by 20, 10, or 5 to arrive at a further customized ball design.

Table 5 shows that as the spin rate and ball speed off the driver increase, the shape factor should also increase to provide optimal aerodynamic performance, e.g., increased flight distance. While the shape factors listed above illustrate preferred embodiments for varying ball constructions and ball speeds, the shape factors listed above for each example may be varied without departing from the spirit and scope of the present invention. For example, in one embodiment, the shape factors listed for each example above may be adjusted upwards or downwards by 20 to arrive at a further customized ball design. More preferably, the shape factors may be adjusted upwards or downwards by 10, and even more preferably it may be adjusted by 5.

Thus, shape factors may be selected for a particular ball construction that result in a ball designed to work well with a wide variety of player swing speeds. For instance, in one embodiment of the present invention, a shape factor between about 65 and about 100 would be suitable for a ball with a cover hardness between about 45 and about 55 shore D.

As such, not only do the preferred ranges of dimple radius and/or diameter, depth, and shape factor discussed above with respect to equations (2) and (8) factor into the design of a dimple profile and overall dimple pattern, the player swing speed will also likely play a role. In this regard, the range of shape factors for dimple profiles based on equations (2) or (8) may be adjusted to cater to a certain player swing speed. For example, while a preferred shape factor range is from about 10 to about 75, this may be adjusted depending on the targeted player swing speed and ball construction.

Dimple Patterns

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball.

In one embodiment of the present invention, the dimple pattern is at least partially defined by phyllotaxis-based patterns, such as those described in copending U.S. Pat. No. 6,338,684, the entire disclosure of which is incorporated by reference in its entirety.

In one embodiment, the selected dimple pattern provides greater than about 50 percent surface coverage. In another embodiment, about 70 percent or more of the golf ball surface is covered by dimples. In yet another embodiment, about 80 percent or more of the golf ball surface is covered by dimples. In still another embodiment, about 90 percent or more of the golf ball surface is covered by dimples. Various patterns with varying levels of coverage are discussed below. Any of these patterns or modification to these patterns are contemplated for use in accordance with the present invention.

Figure 13:
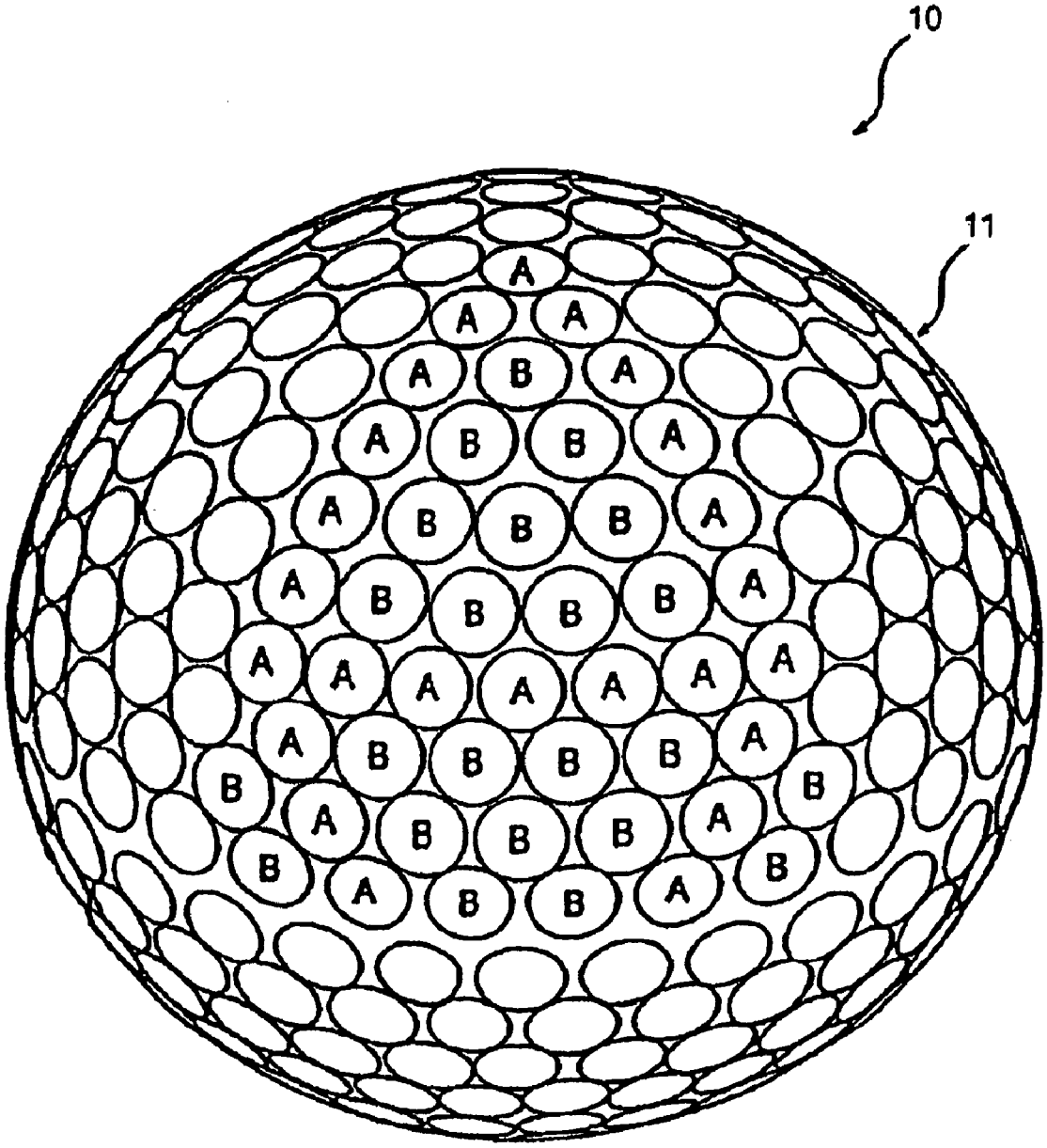
FIG. 13 is an isometric view of the icosahedron pattern used on a golf ball.
Figure 14:
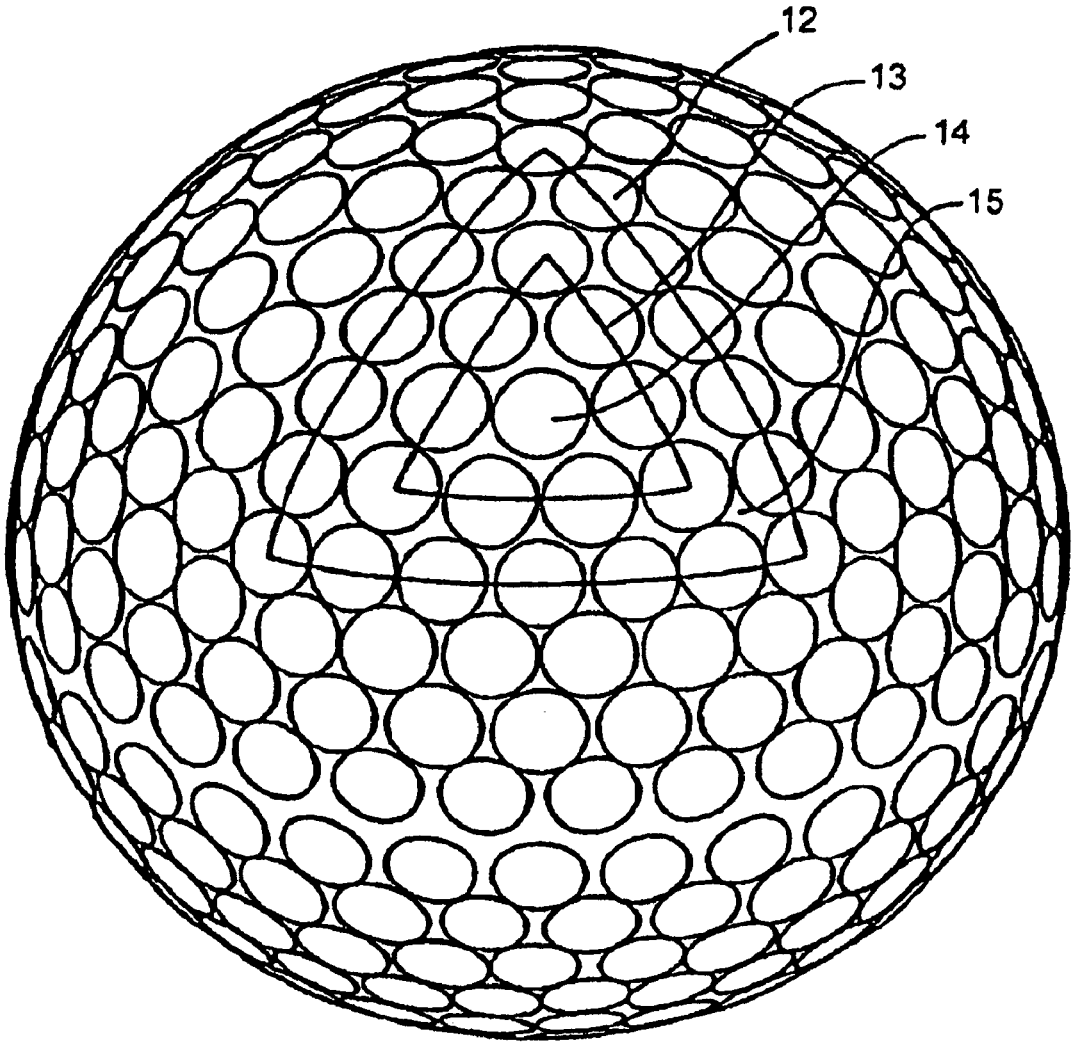
FIG. 14 is an isometric view of the icosahedron pattern used on a golf ball showing the triangular regions formed by the icosahedron pattern.

FIGS. 13 and 14 show a golf ball 10 with a plurality of dimples 11 on the outer surface that are formed into a dimple pattern having two sizes of dimples. The first set of dimples A have diameters of about 0.14 inches and form the outer triangle 12 of the icosahedron dimple pattern. The second set of dimples B have diameters of about 0.16 inches and form the inner triangle 13 and the center dimple 14. The dimples 11 cover less than 80 percent of the outer surface of the golf ball and there is a significant number of large spaces 15 between adjacent dimples, i.e., spaces that could hold a dimple of 0.03 inches diameter or greater.

Figure 15:
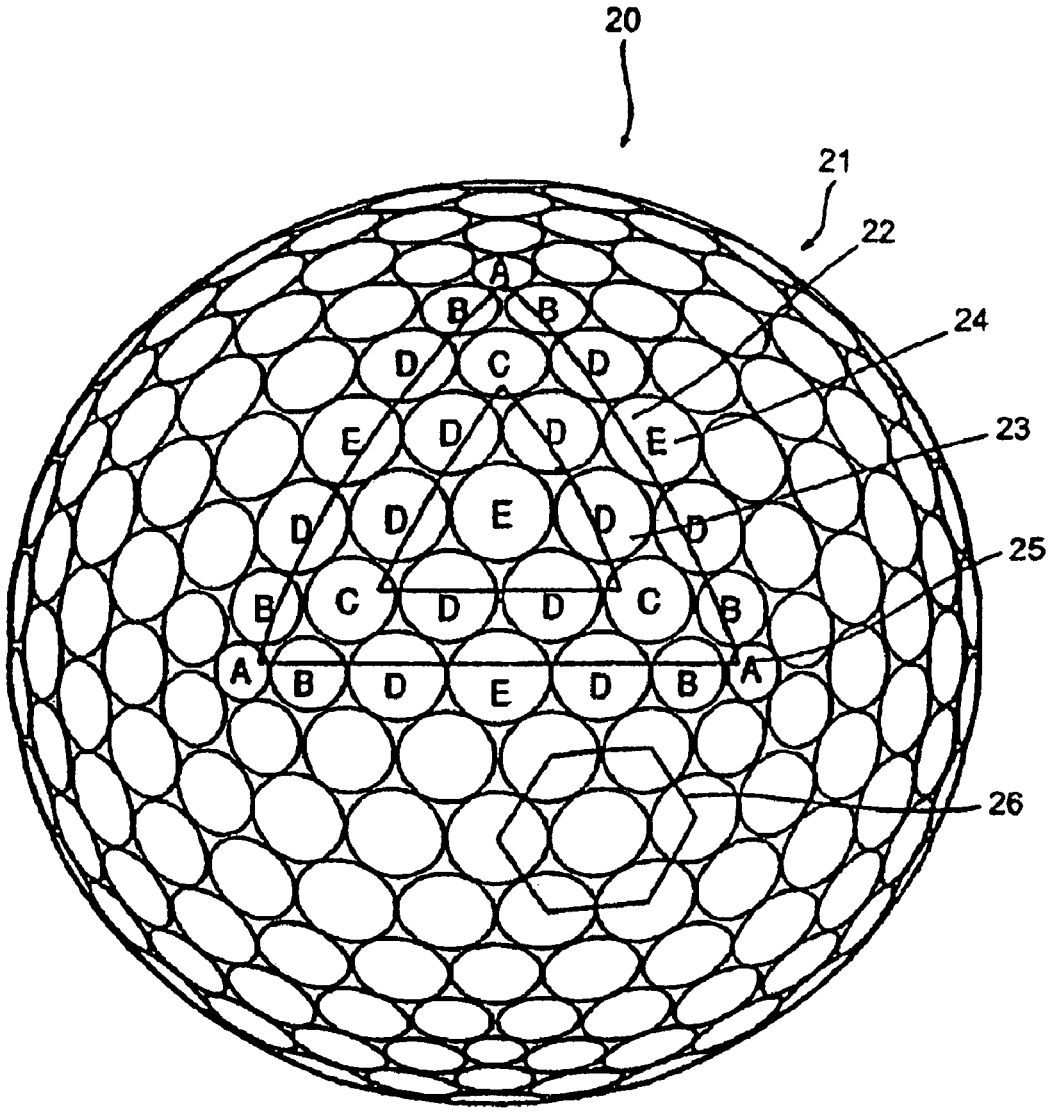
FIG. 15 is an isometric view of a golf ball according to the present invention having an icosahedron pattern, showing dimple sizes.
Figure 16:
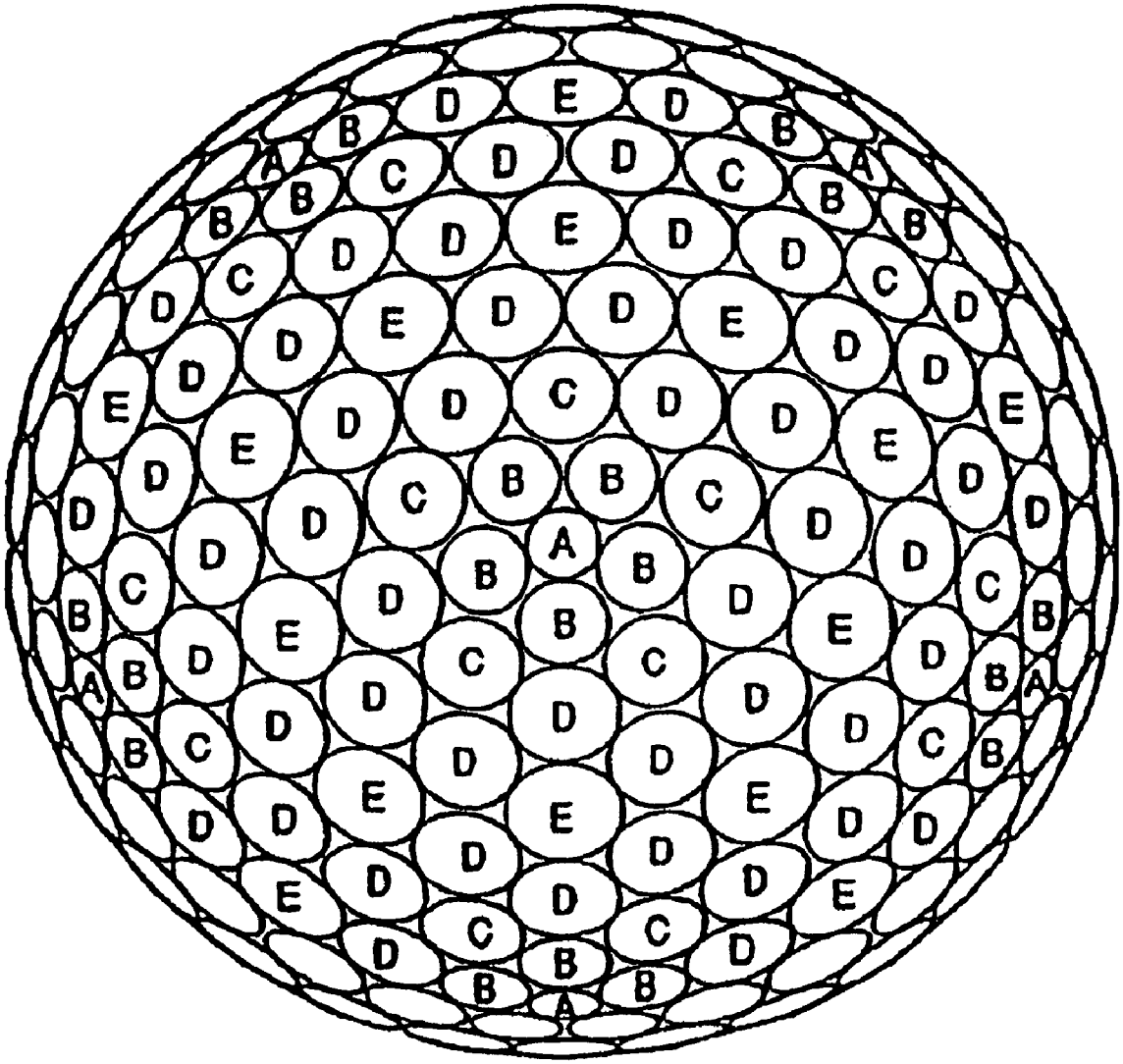
FIG. 16 is a top view of the golf ball in FIG. 15, showing dimple sizes and arrangement.
Figure 17:
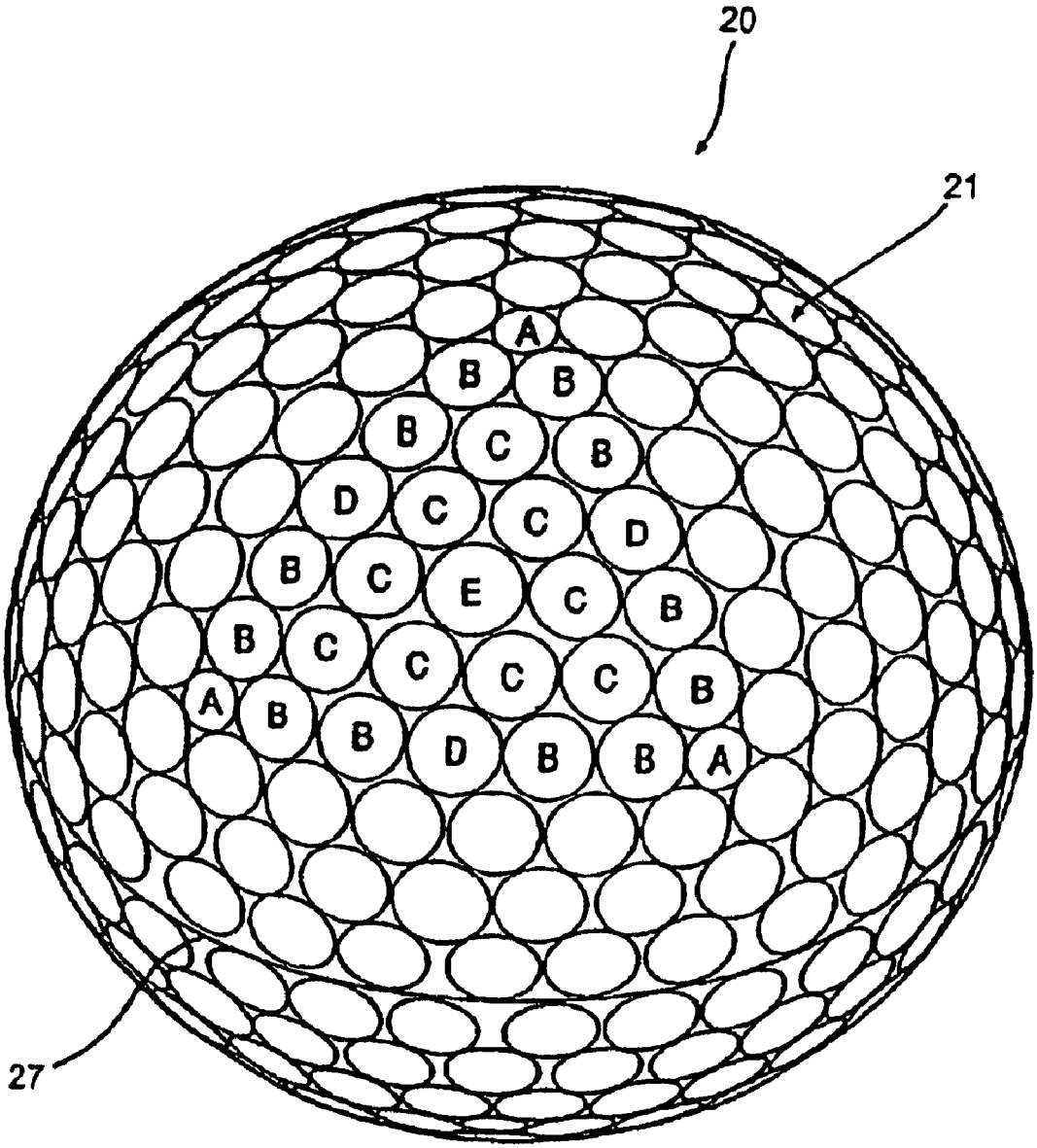
FIG. 17 is an isometric view of another embodiment of a golf ball according to the present invention having an icosahedron pattern, showing dimple sizes and the triangular regions formed from the icosahedron pattern.
Figure 18:
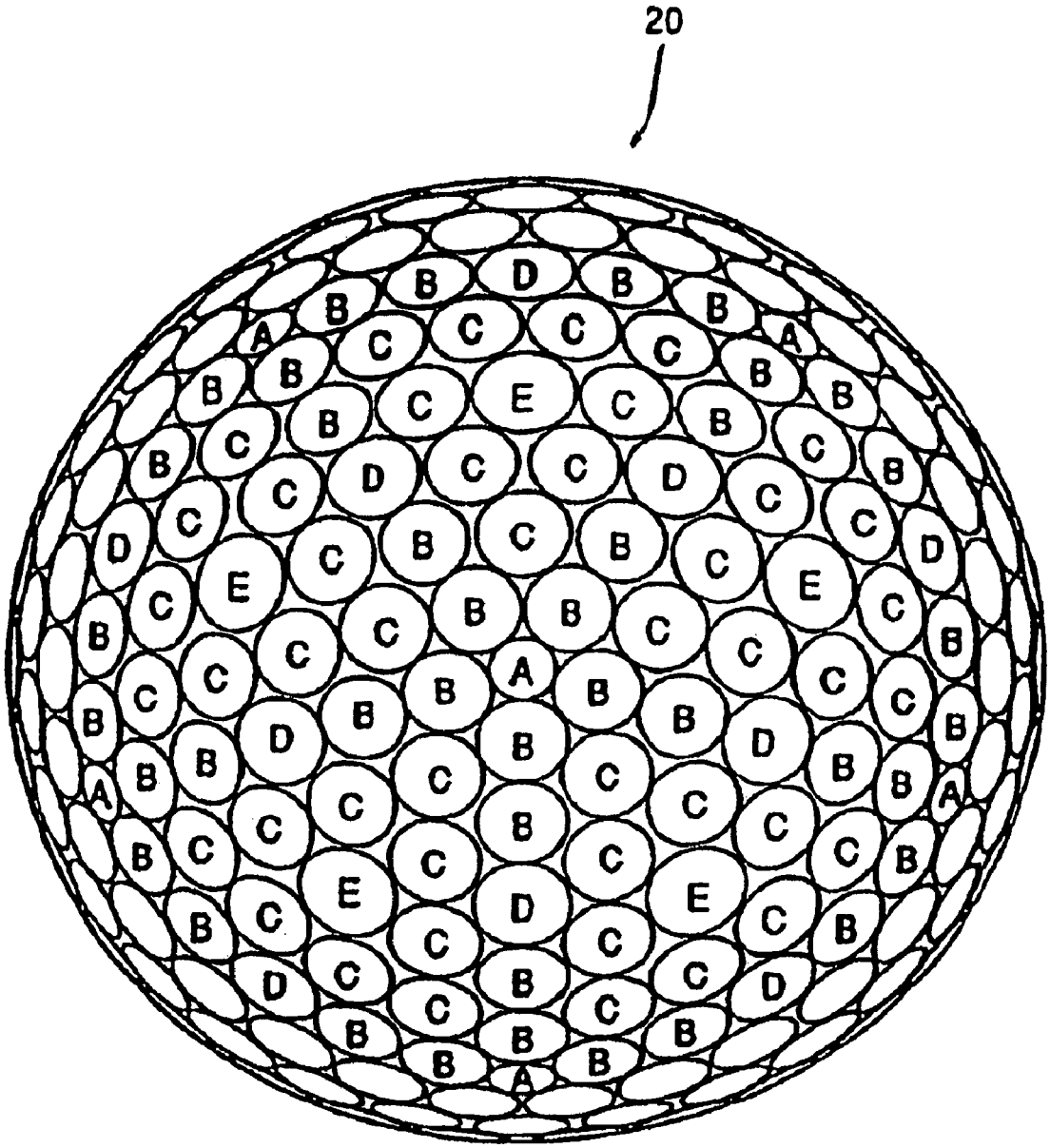
FIG. 18 is a top view of the golf ball in FIG. 17, showing dimple sizes and arrangement.

FIGS. 15 and 16 show a golf ball 20 according to the first dimple pattern embodiment of the present invention with a plurality of dimples 21 in an icosahedron pattern. In an icosahedron pattern, there are twenty triangular regions that are generally formed from the dimples. The icosahedron pattern has five triangles formed at both the top and bottom of the ball, each of which shares the pole dimple as a point. There are also ten triangles that extend around the middle of the ball.

In this first dimple pattern embodiment, there are five different sized dimples A-E, wherein dimples E ($D_E$) are greater than dimples D ($D_D$), which are greater than dimples C ($D_C$), which are greater than dimples B($D_B$), which are greater than dimples A ($D_A$); $D_E>D_D>D_C>D_B>D_A$. Dimple minimum sizes according to this embodiment are set forth in Table 6 below:

TABLE 6

Dimple Sizes for Suitable Dimple Pattern

| Dimple | Percent of Ball Diameter |
|---|---|
| A | 6.55 |
| B | 8.33 |
| C | 9.52 |
| D | 10.12 |
| E | 10.71 |

The dimples of this embodiment are formed in large triangles 22 and small triangles 23. The dimples along the sides of the large triangle 22 increase in diameter toward the midpoint 24 of the sides. The largest dimple along the sides, $D_E$, is located at the midpoint 24 of each side of the large triangle 22, and the smallest dimples, $D_A$, are located at the triangle points 25. In this embodiment, each dimple along the sides is larger than the adjacent dimple toward the triangle point.

FIGS. 17-20 illustrate another suitable dimple pattern contemplated for use on the golf ball of the present invention. In this embodiment, there are again five different sized dimples A-E, wherein dimples E ($D_E$) are greater than dimples D ($D_D$), which are greater than dimples C ($D_C$), which are greater than dimples B($D_B$), which are greater than dimples A ($D_A$); $D_E>D_D>D_C>D_B>D_A$. Dimple minimum sizes according to this embodiment are set forth in Table 7 below:

TABLE 7

Dimple Sizes for Suitable Dimple Pattern

| Dimple | Percent of Ball Diameter |
|---|---|
| A | 6.55 |
| B | 8.93 |
| C | 9.23 |
| D | 9.52 |
| E | 10.12 |

Figure 19:
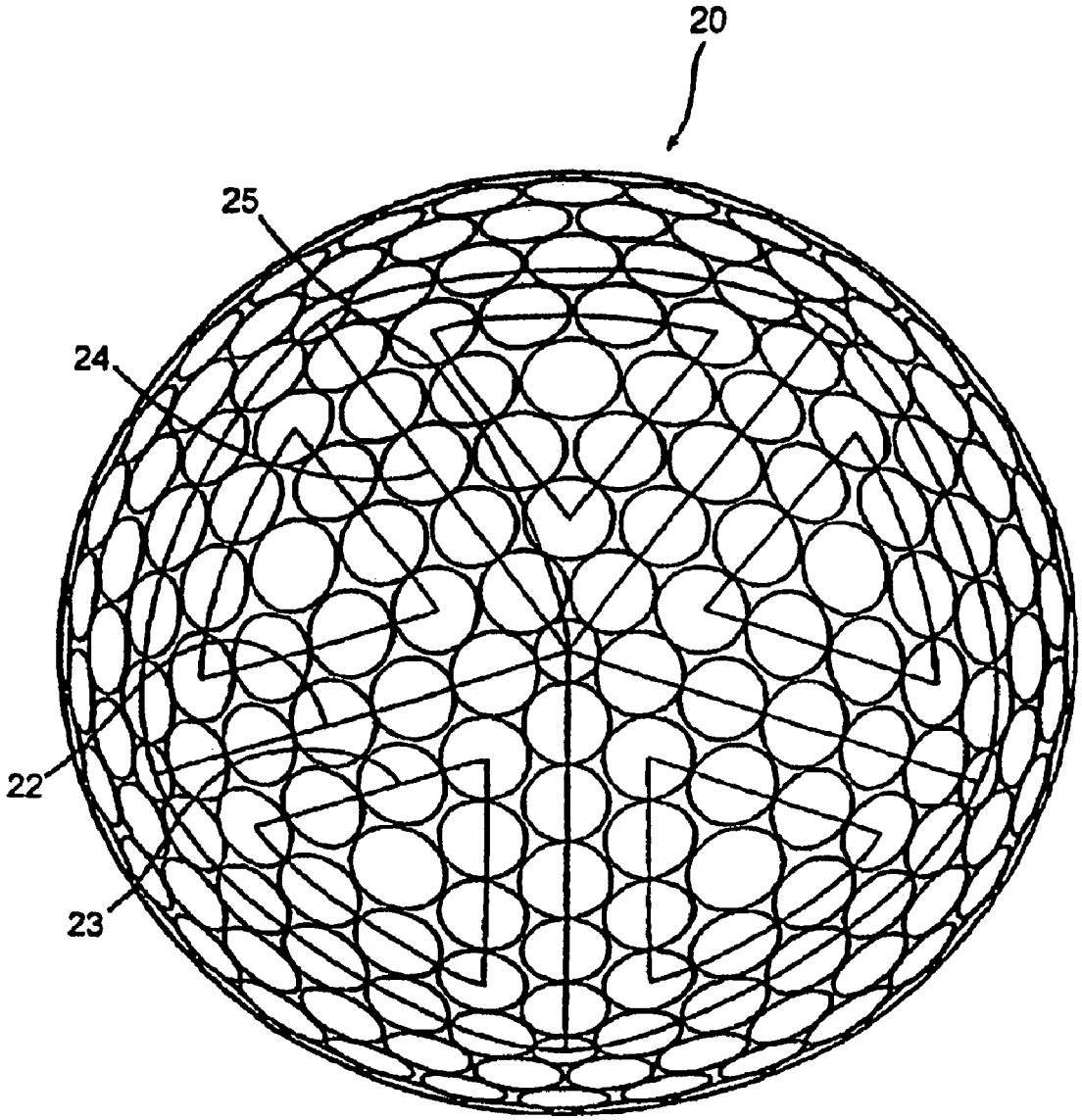
FIG. 19 is a top view of the golf ball in FIG. 17, showing dimple arrangement.
Figure 21:
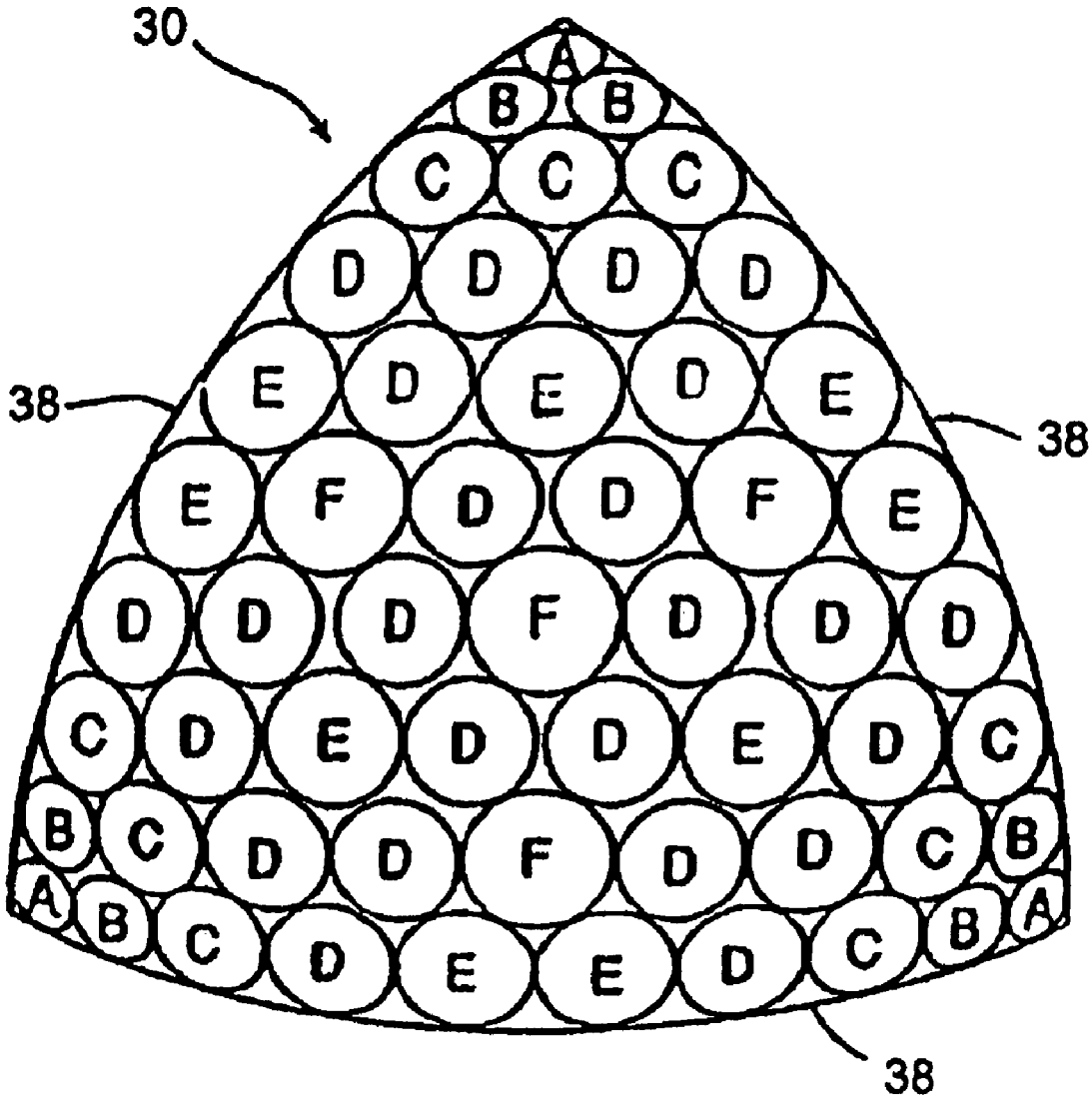
FIG. 21 is a spherical-triangular region of a golf ball according to the present invention having an octahedral dimple pattern, showing dimple sizes.
Figure 22:
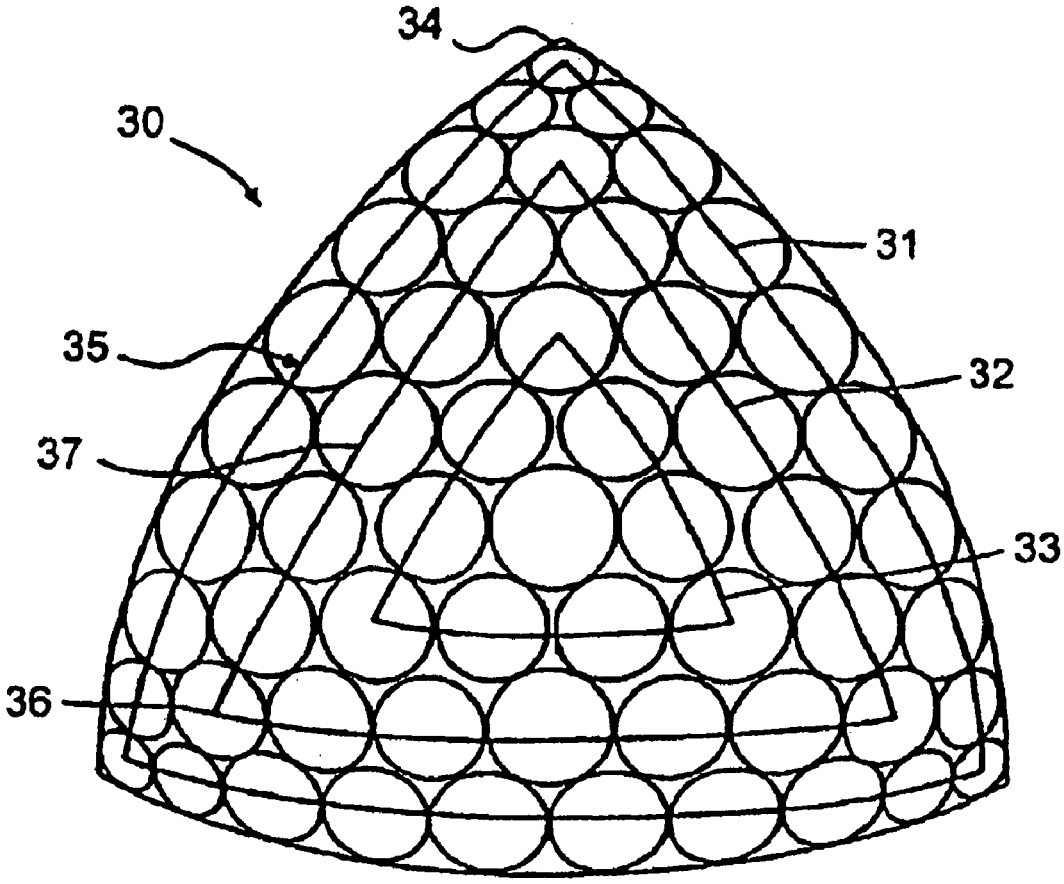
FIG. 22 is the spherical triangular region of FIG. 21, showing the triangular dimple arrangement.

In this dimple pattern, the dimples are again formed in large triangles 22 and small triangles 23 as shown in FIG. 19. The dimples along the sides of the large triangle 22 increase in diameter toward the midpoint 24 of the sides. The largest dimple along the sides, $D_D$, is located at the midpoint 24 of each side of the large triangle 22, and the smallest dimples, $D_A$, are located at the triangle points 25. In this embodiment, each dimple along the sides is larger than the adjacent dimple toward the triangle point, i.e., $D_B>D_A$ and $D_D>D_B$ Another suitable dimple pattern embodiment is illustrated in FIGS. 21-22, wherein the golf ball has an octahedral dimple pattern. In an octahedral dimple pattern, there are eight spherical triangular regions 30 that form the ball. In this dimple pattern, there are six different sized dimples A-F, wherein dimples F ($D_F$) are greater than dimples E ($D_E$), which are greater than dimples D ($D_D$), which are greater than dimples C ($D_C$), which are greater than dimples B($D_B$), which are greater than dimples A ($D_A$); $D_F>D_E>D_D>D_C>D_B>D_A$. Dimple minimum sizes according to this embodiment are set forth in Table 8 below:

TABLE 8

Dimple Sizes for Suitable Dimple Pattern

| Dimple | Percentage of Ball Diameter |
|---|---|
| A | 5.36 |
| B | 6.55 |
| C | 8.33 |
| D | 9.83 |
| E | 9.52 |
| F | 10.12 |

In this dimple pattern embodiment, the dimples are formed in large triangles 31, small triangles 32 and smallest triangles 33. Each dimple along the sides of the large triangle 31 is equal to or larger than the adjacent dimple from the point 34 to the midpoint 35 of the triangle 31. The dimples at the midpoint 35 of the side, $D_E$, are the largest dimples along the side and the dimples at the points 34 of the triangle, $D_A$, are the smallest. In addition, each dimple along the sides of the small triangle 32 is also equal to or larger than the adjacent dimple from the point 36 to the midpoint 37 of the triangle 32. The dimple at the midpoint 37 of the side, $D_F$, is the largest dimple along the side and the dimples at the points 36 of the triangle, $D_C$, are the smallest.

Dimple Packing

In one embodiment, the golf balls of the invention include an icosahedron dimple pattern, wherein each of the sides of the large triangles is formed from an odd number of dimples and each of the side of the small triangles are formed with an even number of dimples.

For example, in the icosahedron pattern shown in FIGS. 15-16 and 17-20, there are seven dimples along each of the sides of the large triangle 22 and four dimples along each of the sides of the small triangle 23. Thus, the large triangle 22 has nine more dimples than the small triangle 23, which creates hexagonal packing 26, i.e., each dimple is surrounded by six other dimples for most of the dimples on the ball. For example, the center dimple, $D_E$, is surrounded by six dimples slightly smaller, $D_D$. In one embodiment, at least 75 percent of the dimples have 6 adjacent dimples. In another embodiment, only the dimples forming the points of the large triangle 25, $D_A$, do not have hexagonal packing. Since $D_A$ are smaller than the adjacent dimples, the gaps between adjacent dimples is surprisingly small when compared to the golf ball shown in FIG. 15.

The golf ball 20 has a greater dispersion of the largest dimples. For example, in FIG. 15, there are four of the largest diameter dimples, $D_E$, located in the center of the triangles and at the mid-points of the triangle sides. Thus, there are no two adjacent dimples of the largest diameter. This improves dimple packing and aerodynamic uniformity. Similarly, in FIG. 17, there is only one largest diameter dimple, $D_E$, which is located in the center of the triangles. Even the next to the largest dimples, $D_D$ are dispersed at the mid-points of the large triangles such that there are no two adjacent dimples of the two largest diameters, except where extra dimples have been added along the equator.

In the last example dimple pattern discussed above, i.e., FIGS. 21-22, each of the sides of the large triangle 31 has an even number of dimples, each of the sides of the small triangle 32 has an odd number of dimples and each of the sides of the smallest triangle 33 has an even number of dimples. There are ten dimples along the sides of the large triangles 31, seven dimples along the sides of the small triangles 32, and four dimples along the sides of the smallest triangles 33. Thus, the large triangle 31 has nine more dimples than the small triangle 32 and the small triangle 32 has nine more dimples than the smallest triangle 33. This creates the hexagonal packing for all of the dimples inside of the large triangles 31.

As used herein, adjacent dimples can be considered as any two dimples where the two tangent lines from the first dimple that intersect the center of the second dimple do not intersect any other dimple. In one embodiment, less than 30 percent of the gaps between adjacent dimples is greater than 0.01 inches. In another embodiment, less than 15 percent of the gaps between adjacent dimples is greater than 0.01 inches.

As discussed above, one embodiment of the present invention contemplates dimple coverage of greater than about 80 percent. For example, the percentages of surface area covered by dimples in the embodiments shown in FIGS. 15-16 and 17-20 are about 85.7 percent and 82 percent, respectively whereas the ball shown in FIG. 14 has less than 80 percent of its surface covered by dimples. The percentage of surface area covered by dimples as shown in FIGS. 21-22 is also about 82 percent, whereas prior art octahedral balls have less than 77 percent of their surface covered by dimples, and most have less than 60 percent. Thus, there is a significant increase in surface area contemplated for the golf balls of the present invention as compared to prior art golf balls.

Parting Line

A parting line, or annular region, about the equator of a golf ball has been found to separate the flow profile of the air into two distinct halves while the golf ball is in flight and reduce the aerodynamic force associated with pressure recovery, thus improving flight distance and roll. The parting line must coincide with the axis of ball rotation. It is possible to manufacture a golf ball without parting line, however, most balls have one for ease of manufacturing, e.g., buffing of the golf balls after molding, and many players prefer to have a parting line to use as an alignment aid for putting.

In one embodiment of the present invention, the golf balls include a dimple pattern containing at least one parting line, or annular region. In another embodiment, there is no parting line that does not intersect any dimples, as illustrated in the golf ball shown in FIG. 15. While this increases the percentage of the outer surface that is covered by dimples, the lack of the parting line may make manufacturing more difficult.

In yet another embodiment, the dimple pattern is such that any dimples adjacent to the parting line are aligned and positioned to overlap across the parting line. In essence, this creates a staggered wave parting line. Examples of such dimple patterns are described in U.S. Pat. Nos. 7,258,632 and 6,969,327 and U.S. Patent Publication No. 2006/0025245, the disclosures of which are incorporated by reference herein.

Figure 20:
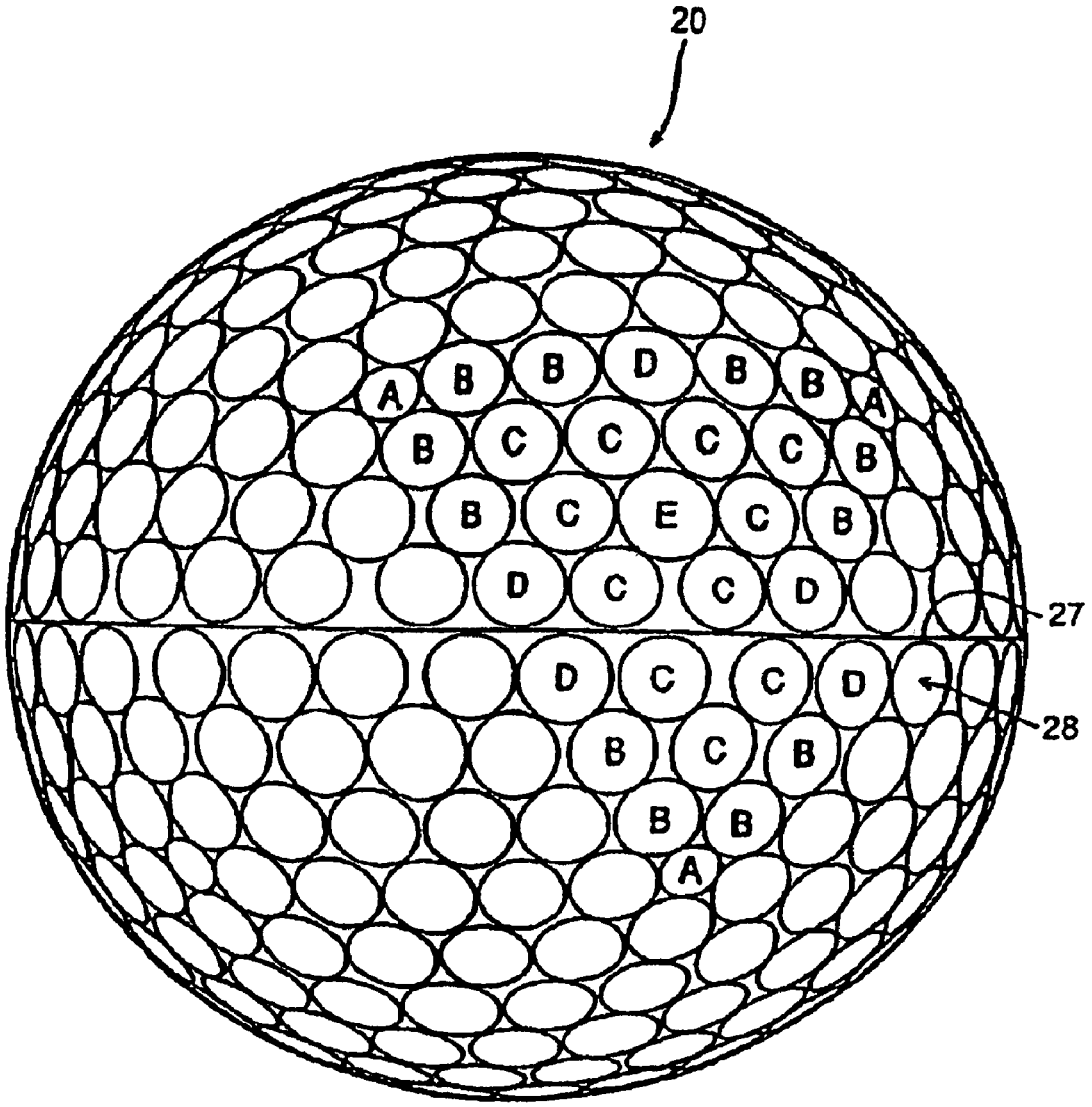
FIG. 20 is a side view of the golf ball in FIG. 17, showing the dimple arrangement at the equator.

In yet another embodiment, the parting line(s) may include regions of no dimples or regions of shallow dimples. For example, most icosahedron patterns generally have modified triangles around the mid-section to create a parting line that does not intersect any dimples. Referring specifically to FIG. 20, the golf ball in this embodiment has a modified icosahedron pattern to create the parting line 27, which is accomplished by inserting an extra row of dimples. In the triangular section identified with lettered dimples, there is an extra row 28 of D-C-C-D dimples added below the parting line 27. Thus, the modified icosahedron pattern in this embodiment has thirty more dimples than the unmodified icosahedron pattern in the embodiment shown in FIGS. 15-16.

In another embodiment, there are more than two parting lines that do not intersect any dimples. For example, the octahedral golf ball shown in FIGS. 21-22 contains three parting lines 38 that do not intersect any dimples. This decreases the percentage of the outer surface as compared to the first embodiment, but increases the symmetry of the dimple pattern. In another embodiment, the golf balls according to the present invention may have the dimples arranged so that there are less than four parting lines that do not intersect any dimples.

Aerodynamic Performance

As discussed generally in the background section, dimples play a key role in the lift and drag on a golf ball. The lift and drag forces are computed as follows:

$$F_{lift}=0.5\ \rho C_1 A V^2 \tag{9}$$

$$F_{drag}=0.5\ \rho C_d A V^2 \tag{10}$$

where: $\rho$=air density $C_1$=lift coefficient $C_d$=drag coefficient

A=ball area=$\pi r^2$ (where r=ball radius), and

V=ball velocity

Lift and drag coefficients are dependent on air density, air viscosity, ball speed, and spin rate and the influence of all of these parameters may be captured by two dimensionless parameters, i.e., Reynolds Number ($N_{Re}$) and Spin Ratio (SR). Spin Ratio is the rotational surface speed of the ball divided by ball velocity. Reynolds Number quantifies the ratio of inertial to viscous forces acting on the golf ball moving through the air. SR and $N_{Re}$ are calculated in equations (11) and (12) below:

$$SR=\omega(D/2)N \tag{11}$$

$$N_{Re}=DV\rho/\mu \tag{12}$$

where $\omega$=ball rotation rate (radians/s) ($2\pi$(RPS))

RPS=ball rotation rate (revolution/s)

V=ball velocity (ft/s)

D=ball diameter (ft)

$\rho$=air density (slugs/ft$^3$)

$\mu$=absolute viscosity of air (lb/ft-s)

There is a number of suitable methods for determining the lift and drag coefficients for a given range of SR and $N_{Re}$, which include the use of indoor test ranges with ballistic screen technology. U.S. Pat. No. 5,682,230, the entire disclosure of which is incorporated by reference herein, teaches the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range.

For a golf ball of any diameter and weight, increased distance is obtained when the lift force, $F_{lift}$, on the ball is greater than the weight of the ball but preferably less than three times its weight. This may be expressed as:

$$W_{ball} \leq F_{lift} \leq 3W_{ball}$$

The preferred lift coefficient range which ensures maximum flight distance is thus:

$$\frac{2W_{ball}}{\pi^2 \rho V^2} \leq C_1 \leq \frac{6W_{ball}}{\pi^2 \rho V^2}$$

The lift coefficients required to increase flight distance for golfers with different ball launch speeds may be computed using the formula provided above. Table 9 provides several examples of the preferred range for lift coefficients for alternative launch speeds, ball size, and weight:

TABLE 9

PREFERRED RANGES FOR LIFT COEFFICIENT FOR A GIVEN BALL DIAMETER, WEIGHT, AND LAUNCH VELOCITY FOR A GOLF BALL ROTATING AT 3000 RPM

| Preferred Minimum $C_l$ | Preferred Maximum $C_l$ | Ball Diameter (in.) | Ball Weight (oz.) | Ball Velocity (ft/s) | Reynolds Number | Spin Ratio |
|---|---|---|---|---|---|---|
| 0.09 | 0.27 | 1.75 | 1.8 | 250 | 232008 | 0.092 |
| 0.08 | 0.24 | 1.75 | 1.62 | 250 | 232008 | 0.092 |
| 0.07 | 0.21 | 1.75 | 1.4 | 250 | 232008 | 0.092 |
| 0.10 | 0.29 | 1.68 | 1.8 | 250 | 222727 | 0.088 |
| 0.09 | 0.27 | 1.68 | 1.62 | 250 | 222727 | 0.088 |
| 0.08 | 0.23 | 1.68 | 1.4 | 250 | 222727 | 0.088 |
| 0.12 | 0.37 | 1.5 | 1.8 | 250 | 198864 | 0.079 |
| 0.11 | 0.33 | 1.5 | 1.62 | 250 | 198864 | 0.079 |
| 0.10 | 0.29 | 1.5 | 1.4 | 250 | 198864 | 0.079 |
| 0.14 | 0.42 | 1.75 | 1.8 | 200 | 185606 | 0.115 |
| 0.13 | 0.38 | 1.75 | 1.62 | 200 | 185606 | 0.115 |
| 0.11 | 0.33 | 1.75 | 1.4 | 200 | 185606 | 0.115 |
| 0.15 | 0.46 | 1.68 | 1.8 | 200 | 178182 | 0.110 |
| 0.14 | 0.41 | 1.68 | 1.62 | 200 | 178182 | 0.110 |
| 0.12 | 0.36 | 1.68 | 1.4 | 200 | 178182 | 0.110 |
| 0.19 | 0.58 | 1.5 | 1.8 | 200 | 159091 | 0.098 |
| 0.17 | 0.52 | 1.5 | 1.62 | 200 | 159091 | 0.098 |
| 0.15 | 0.45 | 1.5 | 1.4 | 200 | 159091 | 0.098 |

Because of the key role a dimple profile plays in lift and drag on a golf ball, once a dimple pattern is selected for the golf ball, the shape factor used in the catenary curve equations may be adjusted to achieve the desired lift coefficient. Effective ways of arriving at the optimal shape factor(s) include wind tunnel testing or using a light gate test range to empirically determine the catenary shape factor that provides the desired lift coefficient at the desired launch velocity. Preferably, the measurement of lift coefficient is performed with the golf ball rotating at typical driver rotation speeds. A preferred spin rate for performing the lift and drag tests is 3,000 rpm.

In addition to selecting particular dimple profiles based on catenary curves, improved flight distance may also be achieved by selecting the dimple pattern and dimple profiles so that specific magnitude and direction criteria are satisfied. In particular, two parameters that account for both lift and drag simultaneously, i.e., 1) the magnitude of aerodynamic force ($C_{mag}$) and 2) the direction of the aerodynamic force (Angle), are linearly related to the lift and drag coefficients. Therefore, the magnitude and angle of the aerodynamic coefficients may be used as an additional tool to achieve the desired aerodynamic performance of the ball. The magnitude and the angle of the aerodynamic coefficients are defined in equations (13) and (14) below:

$$C_{mag} = \sqrt{(C_L^2 + C_D^2)} \tag{13}$$

$$\text{Angle} = \tan^{-1}(C_L/C_D) \tag{14}$$

Table 10 illustrates the aerodynamic criteria for a golf ball of the present invention that results in increased flight distances. The criteria are specified as low, median, and high $C_{mag}$ and Angle for eight specific combinations of SR and $N_{Re}$ Golf balls with $C_{mag}$ and Angle values between the low and the high number are preferred. More preferably, the golf balls of the invention have $C_{mag}$ and Angle values between the low and the median numbers delineated in Table 10. The $C_{mag}$ values delineated in Table 10 are intended for golf balls that conform to USGA size and weight regulations. The size and weight of the golf balls used with the aerodynamic criteria of Table 10 are 1.68 inches and 1.62 ounces, respectively.

TABLE 10

Aerodynamic Characteristics
Ball Diameter = 1.68 inches, Ball Weight = 1.62 ounces

| | | Magnitude[1] | | | Angle[2] (0) | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.25 | 0.271 | 0.28 | 34 | 36 | 38 |
| 184000 | 0.106 | 0.26 | 0.280 | 0.29 | 35 | 38 | 39 |
| 161000 | 0.122 | 0.27 | 0.291 | 0.30 | 37 | 40 | 42 |
| 138000 | 0.142 | 0.29 | 0.311 | 0.32 | 38 | 41 | 43 |
| 115000 | 0.170 | 0.32 | 0.344 | 0.35 | 40 | 42 | 44 |
| 92000 | 0.213 | 0.36 | 0.390 | 0.40 | 41 | 43 | 45 |
| 69000 | 0.284 | 0.40 | 0.440 | 0.45 | 40 | 42 | 44 |

[1]As defined by equation (13)
[2]As defined by equation (14)

To ensure consistent flight performance regardless of ball orientation, the percent deviation of $C_{mag}$ for each of the SR and $N_{Re}$ combinations listed in Table 10 plays an important role. The percent deviation of $C_{mag}$ may be calculated in accordance with equation (15), wherein the ratio of the absolute value of the difference between the $C_{mag}$ for two orientations to the average of the $C_{mag}$ for the two orientations is multiplied by 100.

$$\text{Percent deviation } C_{mag}=|(C_{mag1}-C_{mag2})|/((C_{mag1}+C_{mag2})/2)*100 \quad (15)$$

where $C_{mag1}=C_{mag}$ for orientation 1

$C_{mag2}=C_{mag}$ for orientation 2

In one embodiment, the percent deviation is about 6 percent or less. In another embodiment, the deviation of $C_{mag}$ is about 3 percent or less. To achieve the consistent flight performance, the percent deviation criteria of equation (15) is preferably satisfied for each of the eight $C_{mag}$ values associated with the eight SR and $N_{Re}$ values contained in Table 10.

Aerodynamic asymmetry may arise from parting lines that are inherent in the dimple arrangement or from parting lines associated with the manufacturing process. The percent $C_{mag}$ deviation should be obtained using $C_{mag}$ values measured with the axis of rotation normal to the parting line, commonly referred to as a poles horizontal, PH, orientation and $C_{mag}$ values measured in an orientation orthogonal to PH, commonly referred to as a pole over pole, PP orientation. The maximum aerodynamic asymmetry is generally measured between the PP and PH orientation.

One of ordinary skill in the art would be aware, however, that the percent deviation of $C_{mag}$ as outlined above applies to PH and PP, as well as any other two orientations. For example, if a particular dimple pattern is used having a great circle of shallow dimples, which will be described in greater detail below, different orientations should be measured. The axis of rotation to be used for measurement of symmetry in the above example scenario would be normal to the plane described by the great circle and coincident to the plane of the great circle.

It has also been discovered that the $C_{mag}$ and Angle criteria delineated in Table 10 for golf balls with a nominal diameter of 1.68 and a nominal weight of 1.62 ounces may be advantageously scaled to obtain the similar optimized criteria for golf balls of any size and weight. The aerodynamic criteria of Table 10 may be adjusted to obtain the $C_{mag}$ and angle for golf balls of any size and weight in accordance with equations (16) and (17).

$$C_{mag(ball)}=C_{mag(Table\ 1)}/(\sin(\text{Angle}_{(Table1)})*(W_{bal}/1.62)*(1.68/D_{ball})^2)^2+(\cos(\text{Angle}_{(Table\ 1)})^2) \quad (16)$$

$$\text{Angle}_{(ball)}=\tan^{-1}(\tan(\text{Angle}_{(Table\ 1)})*(W_{ball}/1.62)*(1.68/D_{ball})^2) \quad (17)$$

For example, Table 11 illustrates aerodynamic criteria for balls with a diameter of 1.60 inches and a weight of 1.7 ounces as calculated using Table 10, ball diameter, ball weight, and equations (13) and (14).

TABLE 11

Aerodynamic Characteristics
Ball Diameter = 1.60 inches, Ball Weight = 1.70 ounces

| | | Magnitude[1] | | | Angle[2] (0) | | |
|---|---|---|---|---|---|---|---|
| $N_{Re}$ | SR | Low | Median | High | Low | Median | High |
| 230000 | 0.085 | 0.24 | 0.265 | 0.27 | 31 | 33 | 35 |
| 207000 | 0.095 | 0.262 | 0.287 | 0.297 | 38 | 40 | 42 |
| 184000 | 0.106 | 0.271 | 0.297 | 0.308 | 39 | 42 | 44 |
| 161000 | 0.122 | 0.83 | 0.311 | 0.322 | 42 | 44 | 46 |
| 138000 | 0.142 | 0.304 | 0.333 | 0.346 | 43 | 45 | 47 |
| 115000 | 0.170 | 0.337 | 0.370 | 0.383 | 44 | 46 | 49 |
| 92000 | 0.213 | 0.382 | 0.420 | 0.435 | 45 | 47 | 50 |
| 69000 | 0.284 | 0.430 | 0.473 | 0.489 | 44 | 47 | 49 |

[1]As defined by equation (13)
[2]As defined by equation (14)

Table 12 shows lift and drag coefficients ($C_L$, $C_D$), as well as $C_{mag}$ and Angle, for a golf ball having a nominal diameter of 1.68 inches and a nominal weight of 1.61 ounces, with an icosahedron pattern with 392 dimples and two dimple diameters, of which the dimple pattern will be described in more detail below. The percent deviation in $C_{mag}$ for PP and PH ball orientations are also shown over the range of $N_{Re}$ and SR. The deviation in $C_{mag}$ for the two orientations over the entire range is less than about 3 percent.

TABLE 12

Aerodynamic Characteristics
Ball Diameter = 1.68 inches, Ball Weight = 1.61 ounces

| | | PP Orientation | | | | PH Orientation | | | | |
|---|---|---|---|---|---|---|---|---|---|---|
| $N_{Re}$ | SR | $C_L$ | $C_D$ | $C_{mag}$[1] | Angle[2] | $C_L$ | $C_D$ | $C_{mag}$[1] | Angle[2] | % Dev $C_{mag}$ |
| 230000 | 0.085 | 0.144 | 0.219 | 0.262 | 33.4 | 0.138 | 0.217 | 0.257 | 32.6 | 1.9 |
| 207000 | 0.095 | 0.159 | 0.216 | 0.268 | 36.3 | 0.154 | 0.214 | 0.264 | 35.7 | 1.8 |
| 184000 | 0.106 | 0.169 | 0.220 | 0.277 | 37.5 | 0.166 | 0.216 | 0.272 | 37.5 | 1.8 |
| 161000 | 0.122 | 0.185 | 0.221 | 0.288 | 39.8 | 0.181 | 0.221 | 0.286 | 39.4 | 0.9 |
| 138000 | 0.142 | 0.202 | 0.232 | 0.308 | 41.1 | 0.199 | 0.233 | 0.306 | 40.5 | 0.5 |
| 115000 | 0.170 | 0.229 | 0.252 | 0.341 | 42.2 | 0.228 | 0.252 | 0.340 | 42.2 | 0.2 |
| 92000 | 0.213 | 0.264 | 0.281 | 0.386 | 43.2 | 0.270 | 0.285 | 0.393 | 43.5 | 1.8 |
| 69000 | 0.284 | 0.278 | 0.305 | 0.413 | 42.3 | 0.290 | 0.309 | 0.423 | 43.2 | 2.5 |
| | | | SUM | 2.543 | | | SUM | 2.541 | | |

[1]As defined by equation (16)
[2]As defined by equation (17)

Table 13 shows lift and drag coefficients ($C_L$, $C_D$), as well as $C_{mag}$ and Angle for a prior golf ball having a nominal diameter of 1.68 inches and a nominal weight of 1.61 ounces. The percent deviation in $C_{mag}$ for PP and PH ball orientations are also shown over the range of $N_{Re}$ and SR. The deviation in $C_{mag}$ for the two orientations is greater than about 3 percent over the entire range, greater than about 6 percent for $N_{Re}$ of 161000, 138000, 115000, and 92000, and exceeds 10 percent at a $N_{Re}$ of 69000.

TABLE 13

Aerodynamic Characteristics For Prior Art Golf Ball
Ball Diameter = 1.68 inches, Ball Weight = 1.61 ounces

| | | PP Orientation | | | | PH Orientation | | | | |
|---|---|---|---|---|---|---|---|---|---|---|
| $N_{Re}$ | SR | $C_L$ | $C_D$ | $C_{mag}$[1] | Angle[2] | $C_L$ | $C_D$ | $C_{mag}$[1] | Angle[2] | % Dev $C_{mag}$ |
| 230000 | 0.085 | 0.151 | 0.222 | 0.269 | 34.3 | 0.138 | 0.219 | 0.259 | 32.3 | 3.6 |
| 207000 | 0.095 | 0.160 | 0.223 | 0.274 | 35.6 | 0.145 | 0.219 | 0.263 | 33.4 | 4.1 |
| 184000 | 0.106 | 0.172 | 0.227 | 0.285 | 37.2 | 0.154 | 0.221 | 0.269 | 34.8 | 5.6 |
| 161000 | 0.122 | 0.188 | 0.233 | 0.299 | 38.9 | 0.166 | 0.225 | 0.279 | 36.5 | 6.9 |
| 138000 | 0.142 | 0.209 | 0.245 | 0.322 | 40.5 | 0.184 | 0.231 | 0.295 | 38.5 | 8.7 |
| 115000 | 0.170 | 0.242 | 0.269 | 0.361 | 42.0 | 0.213 | 0.249 | 0.328 | 40.5 | 9.7 |
| 92000 | 0.213 | 0.280 | 0.309 | 0.417 | 42.2 | 0.253 | 0.283 | 0.380 | 41.8 | 9.5 |
| 69000 | 0.284 | 0.270 | 0.308 | 0.409 | 41.2 | 0.308 | 0.337 | 0.457 | 42.5 | 10.9 |
| | | | SUM | 2.637 | | | SUM | 2.531 | | |

[1]As defined by equation (16)
[2]As defined by equation (17)

Table 14 illustrates the flight performance of a golf ball of the present invention having a nominal diameter of 1.68 inches and weight of 1.61 ounces, compared to a prior art golf ball having similar diameter and weight. Each prior art ball is compared to a golf ball of the present invention at the same speed, angle, and back spin.

TABLE 14

Ball Flight Performance, Invention vs. Prior Art Golf Ball
Ball Diameter = 1.68 inches, Ball Weight = 1.61 ounces

| | Ball Orientation | Speed (mph) | Angle | Rotation Rate (rpm) | Distance (yds) | Time (s) | Impact Angle |
|---|---|---|---|---|---|---|---|
| Prior Art | PP | 168.4 | 8.0 | 3500 | 267.2 | 7.06 | 41.4 |
| | PH | 168.4 | 8.0 | 3500 | 271.0 | 6.77 | 36.2 |
| Invention | PP | 168.4 | 8.0 | 3500 | 276.7 | 7.14 | 39.9 |
| | PH | 168.4 | 8.0 | 3500 | 277.6 | 7.14 | 39.2 |
| Prior Art | PP | 145.4 | 8.0 | 3000 | 220.8 | 5.59 | 31.3 |
| | PH | 145.4 | 8.0 | 3000 | 216.9 | 5.18 | 25.4 |
| Invention | PP | 145.4 | 8.0 | 3000 | 226.5 | 5.61 | 29.3 |
| | PH | 145.4 | 8.0 | 3000 | 226.5 | 5.60 | 28.7 |

Table 14 shows an improvement in flight distance for a golf ball of the present invention of between about 6 to about 10 yards over a similar size and weight prior art golf ball. Table 14 also shows that the flight distance of prior art golf balls is dependent on the orientation when struck, i.e., a deviation between a PP and PH orientation results in about 4 yards distance between the two orientations. In contrast, golf balls of the present invention exhibit less than about 1 yard variation in flight distance due to orientation. Additionally, prior art golf balls exhibit large variations in the angle of ball impact with the ground at the end of flight, i.e., about 5°, for the two orientations, while golf balls of the present invention have a variation in impact angles for the two orientations of less than about 1°. A large variation in impact angle typically leads to significantly different amounts of roll when the ball strikes the ground.

Figure 23:
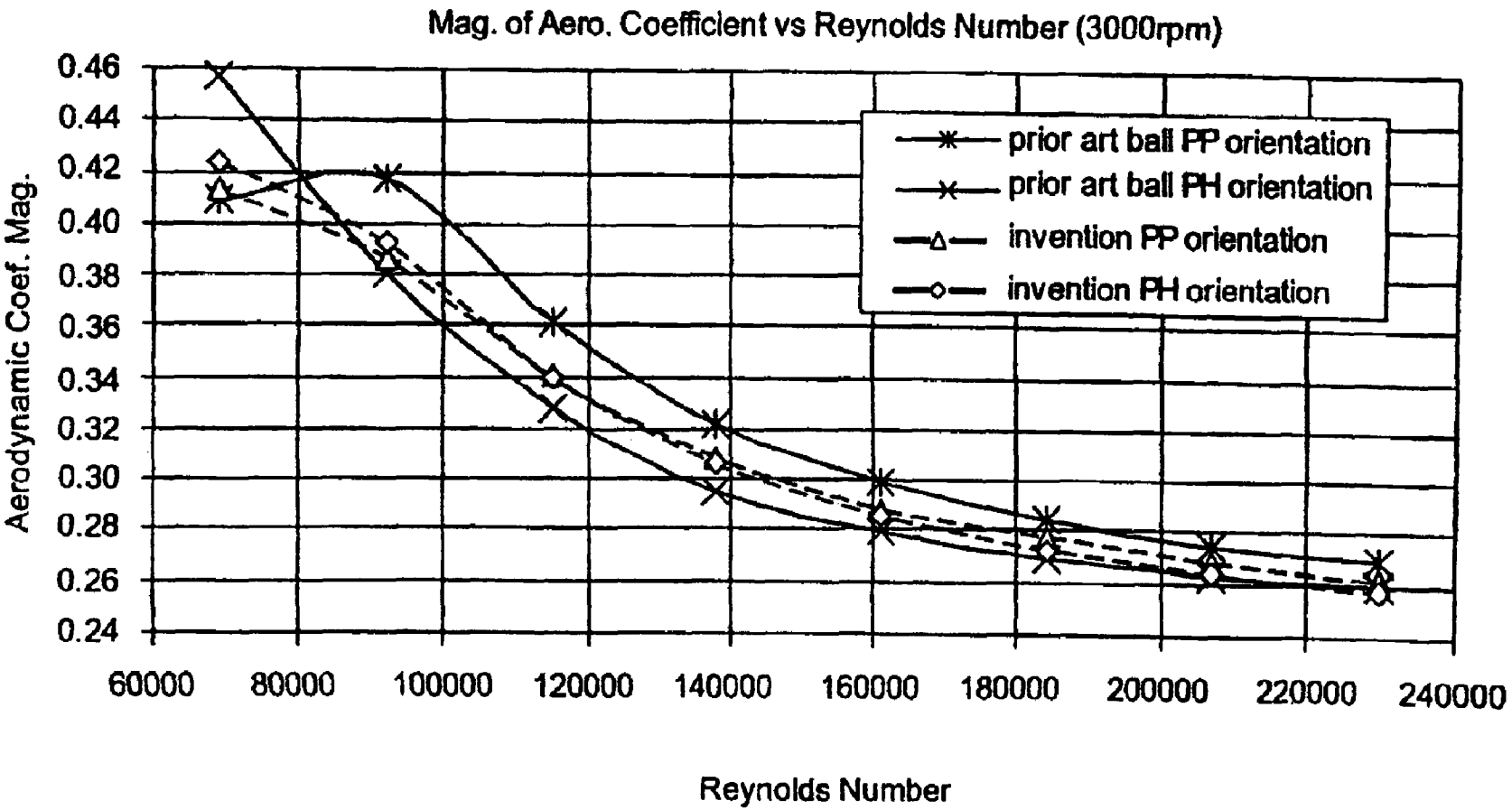
FIG. 23 is a graph of the magnitude of aerodynamic coefficients versus Reynolds Number for a golf ball made according to the present invention and a prior art golf ball.
Figure 24:
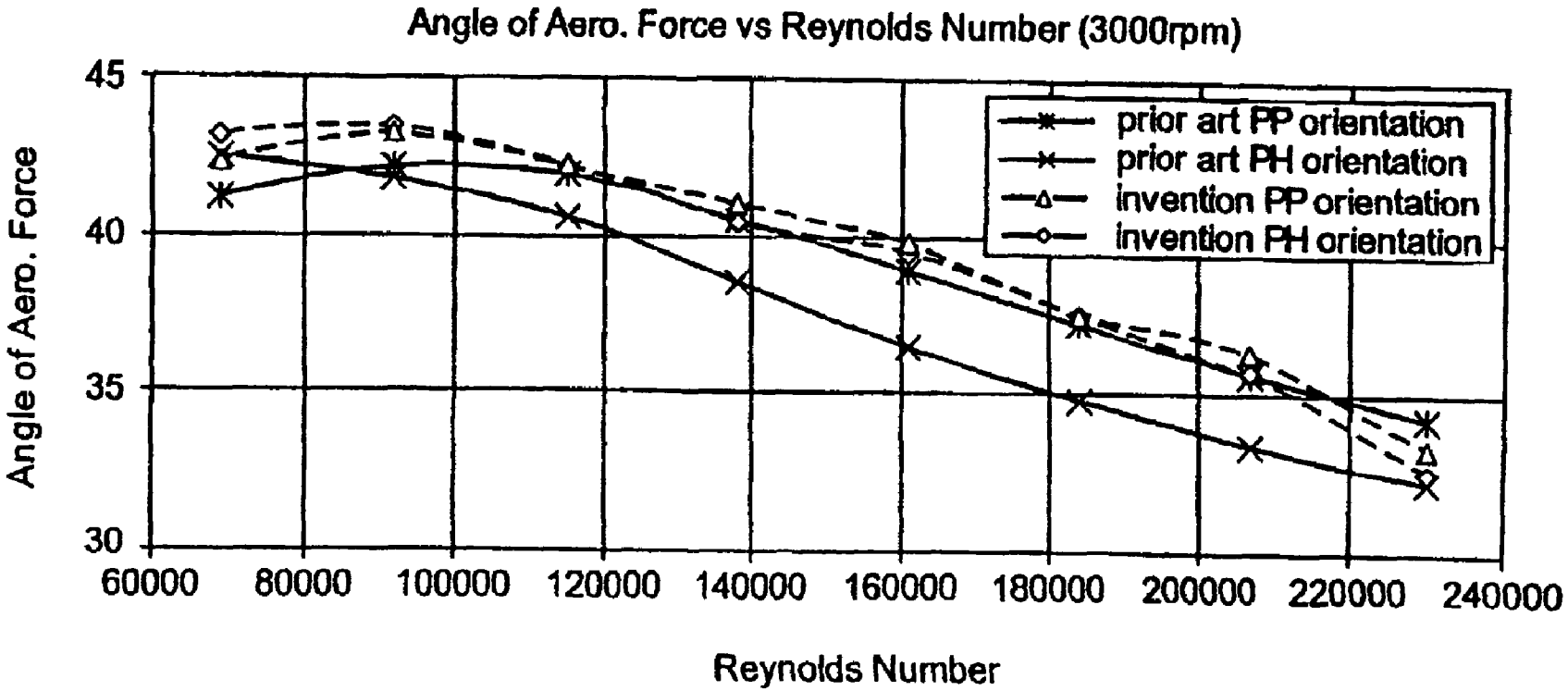
FIG. 24 is a graph of the angle of aerodynamic force versus Reynolds Number for a golf ball made according to the present invention and a prior art golf ball.

The advantageously consistent flight performance of a golf ball of the present invention, i.e., the less variation in flight distance and impact angle, results in more accurate play and potentially yields lower golf scores. FIGS. 23 and 24 illustrate the magnitude of the aerodynamic coefficients and the angle of aerodynamic force plotted versus $N_{Re}$ for a golf ball of the present invention and a prior art golf ball, each having a diameter of about 1.68 inches and a weight of about 1.61 ounces with a fixed spin rate of 3000 rpm. As shown in FIG. 23, the magnitude of the aerodynamic coefficient is substantially lower and more consistent between orientations for a golf ball of the present invention as compared to a prior art golf ball throughout the range of $N_{Re}$ tested. FIG. 24 illustrates that the angle of the aerodynamic force is more consistent for a golf ball of the present invention as compared to a prior art golf ball.

Aerodynamic Symmetry

To create a ball that adheres to the Rules of Golf, as approved by the United States Golf Association, the ball must not be designed, manufactured or intentionally modified to have properties that differ from those of a spherically symmetrical ball. Aerodynamic symmetry allows the ball to fly with little variation no matter how the golf ball is placed on the tee or ground.

Figure 25:
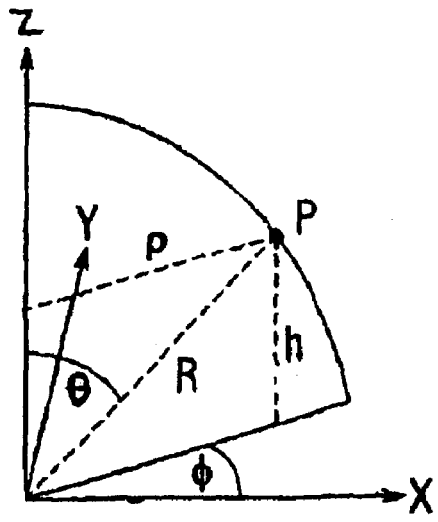
FIG. 25 is a graph illustrating the coordinate system in a dimple pattern according to one embodiment of the invention.

As such, the dimple patterns discussed above are preferably selected and/or designed to cover the maximum surface area of the golf ball without detrimentally affecting the aerodynamic symmetry of the golf ball. A representative coordinate system used to model some of the dimple patterns discussed above is shown in FIG. 25. The XY plane is the equator of the ball while the Z direction goes through the pole of the ball. Preferably, the dimple pattern is generated from the equator of the golf ball, the XY plane, to the pole of the golf ball, the Z direction.

As discussed above, golf balls containing dimple patterns having a parting line about the equator may result in orientation specific flight characteristics. As mentioned above, the parting lines are desired by manufacturers for ease of production, as well as by many golfers for lining up a shot for putting or off the tee. It has now been discovered that selective design of golf balls with dimple patterns including a parting line meeting the aerodynamic criteria set forth in Table 7 result in flight distances far improved over prior art. Geometrically, these parting lines must be orthogonal with the axis of rotation. However, in one embodiment of the present invention, there may be a plurality of parting lines with multiple orientations.

Another way of achieving aerodynamic symmetry or correction for asymmetrical orientation is to use a dimple pattern that congregates a certain amount of relatively shallow dimples about the poles of the golf ball. In this regard, dimples having profiles based on equation (2) using the preferred ranges of chordal depth, diameter, and shape factor are believed to accomplish aerodynamic symmetry. In addition, it is contemplated that dimple profiles based on equation (2) and having chordal depths between about 0.002 inches to about 0.008 inches but not limited to any particular diameter or shaped factor may result in correction of asymmetry.

In another embodiment, asymmetry is overcome through the use of a staggered wave parting line as discussed earlier. For example, at least a portion or all of the dimples adjacent the parting line are aligned with and positioned to overlap corresponding dimples across the parting line.

While it is apparent that the illustrative embodiments of the invention herein disclosed fulfill the objectives stated above, it will be appreciated that numerous modifications and other embodiments may be devised by those skilled in the art.

For example, as used herein, the term "dimple", may include any texturizing on the surface of a golf ball, e.g., depressions and extrusions. Some non-limiting examples of depressions and extrusions include, but are not limited to, spherical depressions, meshes, raised ridges, and brambles. The depressions and extrusions may take a variety of planform shapes, such as circular, polygonal, oval, or irregular. Dimples that have multi-level configurations, i.e., dimple within a dimple, are also contemplated by the invention to obtain desirable aerodynamic characteristics. As such, while the majority of the discussion relating to dimples herein relates to those dimples having profiles based on a catenary curve, other types of dimples fitting the definition in this paragraph are contemplated for use in any portions of the golf ball surface not covered by dimples with catenary curve profiles.

Therefore, it will be understood that the appended claims are intended to cover all such modifications and embodiments which come within the spirit and scope of the present invention.

What is claimed is:

1. A golf ball having a plurality of recessed dimples on the surface thereof, wherein at least a portion of the plurality of recessed dimples have a profile defined by the revolution of a catenary curve according to the following function:

$$y = \frac{d_c(\cosh(sf * x) - 1}{\cosh\left(sf * \frac{D}{2}\right) - 1}$$

wherein y is the vertical direction coordinate away from the center of the ball with 0 at the center of the dimple;

x is the horizontal (radial) direction coordinate from the dimple apex to the dimple surface with 0 at the center of the dimple;

sf is a shape factor;

$d_c$ is the chordal depth of the dimple;

D is the diameter of the dimple; and wherein D is between about 0.115 inches and about 0.185 inches, sf is from about 5 to about 200, and $d_c$ is from about 0.002 inches to about 0.008 inches.

2. The golf ball of claim 1, wherein at least a portion comprises about 50 percent or more of the dimples on the golf ball.

3. The golf ball of claim 1, wherein at least a portion comprises about 80 percent or more of the dimples on the golf ball.

4. The golf ball of claim 1, wherein D is between about 0.125 inches and about 0.185 inches.

5. The golf ball of claim 1, wherein sf is from about 10 to about 100.

6. The golf ball of claim 1, wherein sf is from about 10 to about 75.

7. The golf ball of claim 1, wherein $d_c$ is from about 0.004 inches to about 0.006 inches.

8. The golf ball of claim 1, wherein D is between about 0.115 inches and about 0.185 inches, sf is from about 10 to 100, and $d_c$ is from about 0.004 inches to about 0.006 inches.

9. The golf ball of claim 1, wherein the golf ball comprises a plurality of dimples having an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, wherein $C_L$ is a lift coefficient and $C_D$ is a drag coefficient, wherein the golf ball comprises:

a first aerodynamic coefficient magnitude between about 0.24 and about 0.29 and a first aerodynamic force angle between about 32 degrees and about 39 degrees at a Reynolds Number of about 230000 and a spin ratio of about 0.080; and a second aerodynamic coefficient magnitude between about 0.24 and about 0.29 and a second aerodynamic force angle between about 33 degrees and about 41 degrees at a Reynolds Number of about 208000 and a spin ratio of about 0.090.

10. The golf ball of claim 9, further comprising:

a third aerodynamic coefficient magnitude between about 0.25 and about 0.30 and a third aerodynamic force angle between about 34 degrees and about 42 degrees at a Reynolds Number of about 190000 and a spin ratio of about 0.10; and a fourth aerodynamic coefficient magnitude between about 0.25 and about 0.31 and a fourth aerodynamic force angle between about 35 degrees and about 43 degrees at a Reynolds Number of about 170000 and a spin ratio of about 0.11.

11. A golf ball having a plurality of recessed dimples on the surface thereof, wherein at least a portion of the plurality of recessed dimples have a profile defined by the revolution of a catenary curve according to the following function:

$$y = \frac{d_c(\cosh(sf * x) - 1}{\cosh\left(sf * \frac{D}{2}\right) - 1}$$

wherein y is the vertical direction coordinate away from the center of the ball with 0 at the center of the dimple;

x is the horizontal (radial) direction coordinate from the dimple apex to the dimple surface with 0 at the center of the dimple;

sf is a shape factor and from about 10 to about 75;

$d_c$ is the chordal depth of the dimple and from about 0.004 inches to about 0.006 inches; and D is the diameter of the dimple.

12. The golf ball of claim 11, wherein D is between about 0.115 inches and about 0.185 inches.

13. The golf ball of claim 11, wherein D is between about 0.125 inches and about 0.185 inches.

14. The golf ball of claim 11, wherein at least a portion comprises about 50 percent or more of the dimples on the golf ball.

15. The golf ball of claim 11, wherein at least a portion comprises about 80 percent or more of the dimples on the golf ball.

16. The golf ball of claim 11, wherein the golf ball comprises a plurality of dimples having an aerodynamic coefficient magnitude defined by $C_{mag}=\sqrt{(C_L^2+C_D^2)}$ and an aerodynamic force angle defined by $\text{Angle}=\tan^{-1}(C_L/C_D)$, wherein $C_L$ is a lift coefficient and $C_D$ is a drag coefficient, wherein the golf ball comprises:

a first aerodynamic coefficient magnitude between about 0.24 and about 0.29 and a first aerodynamic force angle between about 32 degrees and about 39 degrees at a Reynolds Number of about 230000 and a spin ratio of about 0.080; and a second aerodynamic coefficient magnitude between about 0.24 and about 0.29 and a second aerodynamic force angle between about 33 degrees and about 41 degrees at a Reynolds Number of about 208000 and a spin ratio of about 0.090.

17. The golf ball of claim 16, further comprising:

a third aerodynamic coefficient magnitude between about 0.25 and about 0.30 and a third aerodynamic force angle between about 34 degrees and about 42 degrees at a Reynolds Number of about 190000 and a spin ratio of about 0.10; and a fourth aerodynamic coefficient magnitude between about 0.25 and about 0.31 and a fourth aerodynamic force angle between about 35 degrees and about 43 degrees at a Reynolds Number of about 170000 and a spin ratio of about 0.11.

18. The golf ball of claim 11, wherein the volume ratio is at least about 0.60.

19. The golf ball of claim 1, wherein the volume ratio is at least about 0.60.

* * * * *